US005386070A

United States Patent [19]

Evans et al.

[11] Patent Number: 5,386,070

[45] Date of Patent: Jan. 31, 1995

[54] PYROLYSIS OF POLYSTYRENE - POLYPHENYLENE OXIDE TO RECOVER STYRENE AND USEFUL PRODUCTS

[75] Inventors: Robert J. Evans, Lakewood; Helena L. Chum, Arvada, both of Colo.

[73] Assignee: Midwest Research Institute, Kansas City, Mo.

[21] Appl. No.: 943,535

[22] Filed: Oct. 27, 1992

Related U.S. Application Data

[62] Division of Ser. No. 711,546, Jun. 7, 1991, Pat. No. 5,216,149.

[51] Int. Cl.[6] ..... C07C 4/22

[52] U.S. Cl. ..... 585/241; 585/242

[58] Field of Search ..... 585/241, 242

[56] References Cited

U.S. PATENT DOCUMENTS

| | | | |
|---|---|---|---|
| 2,383,922 | 8/1945 | Soday | 585/241 |
| 5,072,068 | 10/1991 | Luo et al. | 585/241 |
| 5,136,117 | 8/1992 | Paisley et al. | 585/241 |
| 5,216,149 | 6/1993 | Evans et al. | 540/538 |

FOREIGN PATENT DOCUMENTS

| | | | |
|---|---|---|---|
| 451317 | 9/1918 | Canada | 585/241 |
| 50-55122 | 4/1980 | Japan | 585/241 |

*Primary Examiner*—Asok Pal

*Attorney, Agent, or Firm*—Ken Richardson; Edna M. O'Connor

[57] ABSTRACT

A process of using fast pyrolysis in a carrier gas to convert a polystyrene and polyphenylene oxide plastic waste to a given polystyrene and polyphenylene oxide prior to pyrolysis of other plastic components therein comprising:

selecting a first temperature range to cause pyrolysis of given polystyrene and polyphenylene oxide and its high value monomeric constituent prior to a temperature range that causes pyrolysis of other plastic components;

selecting a catalyst and a support and treating the feed stream with the catalyst to affect acid or base catalyzed reaction pathways to maximize yield or enhance separation of high value monomeric constituent of styrene from polystyrene and polyphenylene oxide in the first temperature range;

differentially heating the feed stream at a heat rate within the first temperature range to provide differential pyrolysis for selective recovery of the high value monomeric constituent of styrene from polystyrene and polyphenylene oxide prior to pyrolysis of other plastic components;

separating the high value monomer constituent of styrene;

selecting a second higher temperature range to cause pyrolysis to a different derived high value product of polyphenylene oxide from the plastic waste and differentially heating the feed stream at the higher temperature range to cause pyrolysis of the plastic into a polyphenylene oxide derived product; and separating the different derived high value polyphenylene oxide product.

8 Claims, 28 Drawing Sheets

PYROLYSIS OF POLYSTYRENE - POLYPHENYLENE OXIDE TO RECOVER STYRENE AND USEFUL PRODUCTS

This is a division of application Ser. No. 07/711,546 filed Jun. 7, 1991, now U.S. Pat. No. 5,216,149.

CONTRACTUAL ORIGIN OF THE INVENTION

The United States Government has rights in this invention under Contract No. DE-ACO2-83H10093 between the United States Department of Energy and the Solar Energy Research Institute, a Division of the Midwest Research Institute.

BACKGROUND OF TEE INVENTION

1. Field of the Invention

In general, the invention pertains to a method for controlling the pyrolysis of a complex waste stream of plastics to convert the stream into useful high value monomers or other chemicals, thereby minimizing disposal requirements for non-biodegradable materials and conserving non-renewable resources. The method uses fast pyrolysis for sequentially converting a plastic waste feed stream having a mixed polymeric composition into high value monomer products by:

- using molecular beams mass spectrometry (MBMS) techniques to characterize the polymeric components of the feed stream and determine process parameter conditions;
- catalytically treating the feed stream to affect the rate of conversion and reaction pathways to specific products; and
- differentially heating the feed stream containing catalyst according to a heat rate program using predetermined MBMS data to sequentially obtain optimum quantities of high value monomer and other high value products from the selected components in the feed stream.

From the conditions selected using the MBMS, batch or continuous reactors can be designed or operated to convert mixed plastic streams into high value chemicals and monomers.

The invention achieves heretofore unattained control of a pyrolysis process, as applied to mixed polymeric waste, through greater discovery of the mechanisms of polymer pyrolysis, as provided through the use of molecular beam mass spectrometry. Pyrolysis mass spectrometry is used to characterize the major polymers found in the waste mixture, and the MBMS techniques are used on large samples in a manner such that heterogeneous polymeric materials can be characterized at the molecular level. After characterization, in accordance with the method of invention, when a given a specific waste stream polymer mixture, that mixture is subjected to a controlled heating rate program for maximizing the isolation of desired monomer and other high value products, due to the fact that the kinetics of the depolymerization of these polymers have been determined as well as the effects of catalytic pretreatment which allow accelerating specific reactions over others, thus permitting control of product as a function of catalyst and temperature (heating rate).

2. Description of the Prior Art

U.S. Pat. No. 3,546,251 pertains to the recovery of epsilon-caprolactone in good yield from oligomers or polyesters by heating at 210°-320° C. with 0.5 to 5 parts weight of catalyst (per 100 parts weight starting material) chosen from KOH, NaOH, alkali earth metal hydroxides, the salts of metals e.g. Co and Mn and the chlorides and oxides of divalent metals.

U.S. Pat. No. 3,974,206 to Tatsumi et al. discloses a process for obtaining a polymerizable monomer by: contacting a waste of thermoplastic acrylic and styrenic resin with a fluid heat transfer medium; cooling the resulting decomposed product; and subjecting it to distillation. This patent uses not only the molten mixed metal as an inorganic heat transfer medium (mixtures or alloys of zinc, bismuth, tin, antimony, and lead, which are molten at very low temperatures) alone or in the presence of added inorganic salts, such as sodium chloride, etc., molten at <500° C. but an additional organic heat transfer medium, so that the plastic waste does not just float on the molten metal, and thereby not enjoy the correct temperatures for thermal decomposition (>500° C.). The molten organic medium is a thermoplastic resin, and examples are other waste resins such as atatic polypropylene, other polyolefins, or tar pitch. The added thermoplastic is also partially thermally decomposed into products that end up together with the desired monomers, and therefore, distillation and other procedures have to be used to obtain the purified monomer.

However, since Tatsumi et al. deal with acrylic polymers known to decompose thermally-into their corresponding monomers, the patent provides no means for identifying catalyst and temperature conditions that permit decomposition of that polymer in the presence of others, without substantial decomposition of the other polymers, in order to make it easier to purify the monomer from the easier to decompose plastic or other high-value chemicals from this polymer.

U.S. Pat. No. 3,901,951 to Nishizaki pertains to a method of treating waste plastics in order to recover useful components derived from at least one monomer selected from aliphatic and aromatic unsaturated hydrocarbons comprising: melting the waste plastic, bringing the melt into contact with a particulate solid heat medium in a fluidized state maintained at a temperature of between 350° to 650° C. to cause pyrolysis of the melt, and collecting and condensing the resultant gaseous product to recover a mixture of liquid hydrocarbons; however, even though one useful monomer (styrene) is cited, the examples produce mixtures of components, all of which must be collected together and subsequently subjected to extensive purification. No procedure is evidenced or taught for affecting fractionation in the pyrolysis itself by virtue of the catalysts and correct temperature choice.

U.S. Pat. No. 3,494,958 to Mansfield et al. is directed to a process for thermal decomposition of polymers such as polymethyl methacrylate using the fluidized bed approach, comprising: taking finely divided polymers of grain size less than 5 mm and windsifting and pyrolysing said polymer grains at a temperature which is at least 100° C. over the depolymerization temperature to produce monomeric products; however, this is a conventional process that exemplifies the utility of thermal processing in general for recovery of monomers from acrylic polymers which, along with polytetrafluoroethylene, are the only classes of polymers which have monomers recovered in high yield by thermal decomposition. See, for instance, A. G. Buekens in Conservation and Recycling, Vol. 1, pp. 241-271 (1977). The process of this patent does not acknowledge the need of taking the recovery a step further in the case of more complex mixtures of products, let alone provide a means for doing so.

U.S. Pat. Nos. 4,108,730 and 4,175,211 to Chen et al. relate respectively to treating rubber wastes and plastic wastes by size reducing the wastes, removing metals therefrom, and slurrying the wastes in a petroleum—derived stream heated to 500°–700° F. to dissolve the polymers. The slurry is then fed into a zeolite catalytic cracker operating at 850° F. and up to 3 atmospheres to yield a liquid product, which is a gasoline-type of product.

While the Chen et al. references exemplify catalytic conversion, it is to a mixture of hydrocarbons boiling in the gasoline range, and not to make specific useful compounds(s), which can be formed and isolated by virtue of temperature programming and catalytic conditions.

U.S. Pat. No. 3,829,558 to Banks et al is directed to a method of disposing of plastic waste without polluting the environment comprising: passing the plastic to a reactor, heating the plastic in the presence of a gas to at least the decomposition temperature of the plastic, and recovering decomposition products therefrom. The gas used in the process is a heated inert carrier gas (as the source of heat).

The method of this patent pyrolyses the mixtures of PVC, polystyrene, polyolefins (in equal proportions) at over 600° C., with steam heated at about 1300° C., and makes over 25 products, which were analyzed for, including in the order of decreasing importance, HCl, the main product, butenes, butane, styrene, pentenes, ethylene, ethane, pentane and benzene, among others.

In Banks, no attempt is made to try to direct the reactions despite the fact that some thermodynamic and kinetic data are obtained.

U.S. Pat. No. 3,996,022 to Larsen discloses a process for converting waste solid rubber scrap from vehicle tires into useful liquid, solid and gaseous chemicals comprising: heating at atmospheric pressure a molten acidic halide Lewis salt or mixtures thereof to a temperature from about 300° C. to the respective boiling point of said salt in order to convert the same into a molten state; introducing into said heated molten salt solid waste rubber material for a predetermined time; removing from above the surface of said molten salt the resulting distilled gaseous and liquid products; and removing from the surface of said molten salt at least a portion of the resulting carbonaceous residue formed thereon together with at least a portion of said molten salt to separating means from which is recovered as a solid product, the solid carbonaceous material.

In the Larsen reference, the remainder from the liquid and gaseous fuel products is char. Moreover, these products are fuels and not specific chemicals.

Table 1 summarizes examples from the literature on plastic pyrolysis.

TABLE 1

Thermal decomposition of polymers (adapted from Buckens)

| Process developed by | Reactor type & heating method | Reaction temperature, °C. | Plant capacity, tons/day | Feedstock | Products | References |
|---|---|---|---|---|---|---|
| a) Union Carbide | Extruder, followed by annular pyrol, tube, electrically heated | 420-600 | 0.035-0.07 | PE, PP, PS, PVC, PETP, PA, mixes | Waxes | |
| b) Japan Steel Works | Extruder | | | | | |
| c) Japan Gasoline Co. | Tubular reactor, externally heated | | | Dissolved or suspended in recycle-oil | Heavy-oil | |
| d) Prof. Tsutsumi | Tubular reactor, superheated steam as a heat carrier | 500-650 | 1 | PS-foam | | |
| e) Nichimen* | Calalytic fixed bed reactor | | | Mixed plast, no char-forming polymers | | |
| f) Toyo Engineering Corp. | Fluidized bed catalytic reactor | | 0.5 | Mixed plast., no char-forming polymers | | |
| g) Mitsui Shipbuilding & Engineering Co. | Stirred tank reactor, polymer bath | 420-455 | 24-30 | Low mol. w. polymers (PE, APPO | Fuel-oil | |
| h) Mitsui Petrochemical Industries Co. (Chiba Works) | | | | | | |
| i) Mitsubishi Heavy Ind. (Mihara Works) | Tank reactor with circulation pump and reflux cooling | 400-500 | 0.7/2.4 | Polyolefins | Naphtha kerosene fuel-oil | |
| j) Kawasaki Heavy Ind. (Kakogawa Works) | Polymer bath, formed by PE and PS | 400-450 | 5 | Mixed plast. PE + PS content 55% | Gas-oil HCL | |
| k) Ruhrchemie AG, Oberhausen | Stirred tank reactor, salt bath | 380-450 | 1.2 | PE | Oil, wax | |
| l) Japan Gasoline Co. | Fluidized bed | 450 | 0.2 | PS-waste | | |
| m) Prof. Sinn, Univ. of Hamburg Prof. Kaminsky | Fluidized bed<br>Molten salt bath | 640-840<br>600-800 | Laboratory scale<br>Laboratory scale | PE, PS, PVC tyre rubber | Aromatic hydro-carbons & fuel oil | |
| n) Sanyo Electric Co. | Tubular reactor with a screw for carbon removal, dielectric heating | 260 (PVC), followed by 500-550 | 0.3 (pilot)<br>3 (Gifu)<br>5 (Kusatsu) | Foam PS. mixed plast. (select. collect) assphalt 6% S | Monomer<br>Fuel-oil<br>HCL | |
| o) Sumitomo Shipbuild. & Machinery Co. (Hiratsuka Lab.) | Fluidized bed, partial oxidation | 450-470<br>600 (28) | 3-5 | Mixed plastics incl. PVC | Heavy oil<br>HCL | |
| p) Government Industrial Research Institute | Fluidized bed, partial oxidation | 400-510<br>550 | Bed diameter: 3.5/15/30/50 & 120 cm | PS-chips | Monomer and dimer<br>Gasific. prod. | |
| q) Nippon Zeon, Japan Gasoline Co. (Tokuyama) | Fluidized bed, partial oxidation | 350-600<br>(400-500 mostly) | 24 pre-commercial plant | Sheared tyres | Gas, oil, char | |
| r) Kobe Steel | Externally heated, rotary kiln | 600-800 | 5 (pilot) | Crushed types | Gas, oil, char | |
| s) Bureau of Mines/ Firestone | Electrically heated retort | 500/900 | Laboratory scale | Tyre cuttings | Gas, oil, char | |
| t) Hydrocarbon Research Inc. | Autoclave | 350-450 | | Tyres | | |
| u) Zeplichal | Conveyor band, vacuum | | | Tyres | | |
| v) Herbold, W. Germany | | | | Tyres | | |

References - Modified from A. G. Buekens, "Some Observations On The Recycling of Plastics and Rubber" in Conservation and Recycling, Vol. 1, pp. 247-271 (1977)

SUMMARY OF THE INVENTION

One object of the present invention is to provide a method for controlling the pyrolysis of a complex waste stream of plastics to convert the stream into useful high value monomers or other chemicals, by identifying catalyst and temperature conditions that permit decomposition of a given polymer in the presence of others, without substantial decomposition of the other polymers, in order to make it easier to purify the monomer from the easier to decompose plastic.

A further object of the invention is to provide a method for controlling the pyrolysis of a complex waste stream of plastics by affecting fractionation in the pyrolysis itself by virtue of the catalysts and correct temperature choice.

A yet further object of the invention is to provide a method of using fast pyrolysis to convert a plastic waste feed stream having a mixed polymeric composition into high value monomer products or chemicals by:

- using molecular beam mass spectrometry (MBMS) to characterize the components of the feed stream;
- catalytically treating the feed stream to affect the rate of conversion and reaction pathways to be taken by the feed stream leading to specific products;
- selection of coreactants, such as steam or methanol in the gas phase or in-situ generated HCl; and
- differentially heating the feed stream according to a heat rate program using predetermined MBMS data to provide optimum quantities of said high value monomer products or high value chemicals.

A still further object of the invention is to provide a method of using fast pyrolysis to convert waste from plastic manufacture of nylon, polyolefins, polycarbonates, etc., wastes from the manufacture of blends and alloys such as polyphenyleneoxide (PPO)/PS and polycarbonate (PC)/ABS by using molecular beam mass spectrometry to identify process parameters such as catalytic treatment and differential heating mentioned above in order to obtain the highest value possible from the sequential pyrolysis of the mixed waste. After these conditions are identified with MBMS, engineering processes can be designed based on these conditions, that can employ batch and continuous reactors, and conventional product recovery condensation trains. Reactors can be fluidized beds or other concepts.

Another object of the invention is to provide a method of using controlled pyrolysis to convert waste from consumer products manufacture such as scrap plastics or mixed plastic waste from the plants in which these plastics are converted into consumer products (e.g., carpet or textile wastes, waste from recreational products manufacture, appliances, etc.), in which case, the number of components present in the waste increases as does the complexity of the stream by using molecular beam mass spectrometry to find the reaction conditions for catalytic treatment and differential heating mentioned above. After these conditions are identified with MBMS, engineering processes can be designed based on these conditions, that can employ batch and continuous reactors, and conventional product recovery condensation trains. Reactors can be fluidized beds or other concepts.

Still another object of the present invention is to provide a method of using controlled pyrolysis to convert wastes from plastic manufacture, consumer product manufacture and the consumption of products such as source separated mixed plastics (or individually sorted types); mixed plastics from municipal waste; and mixed plastics from durable goods (e.g., electrical appliances and automobiles) after their useful life, by using the molecular beam mass spectrometry to find the reaction conditions for catalytic treatment and differential heating mentioned above. After these conditions are identified with MBMS, engineering processes can be designed based on these conditions, that can employ batch and continuous reactors, and conventional product recovery condensation trains. Reactors can be fluidized beds or other concepts.

BRIEF DESCRIPTION OF THE DRAWINGS

The accompanying drawings which are incorporated in and form a part of the specification will illustrate preferred embodiments of the present invention, and together with the description, will serve to explain the principles of the invention.

FIG. 4A shows time-resolved evolution profiles for caprolactam (represented by the ion at m/z 113).

FIG. 4B shows an ionization fragment ion of the caprolactam dimer (m/z 114).

FIG. 4C shows a characteristic ionization fragment ion of propylene-derived hydrocarbons (m/z 69,$C_5H_9^+$).

FIG. 4D shows that the peaks are overlapped and that the products from the two polymers cannot be separated as shown in the integrated spectrum for the pyrolysis.

FIG. 9A shows the temperature trace.

FIG. 9B shows the time-resolved profile for the caprolactam-derived ion m/z 113.

FIG. 9C shows the integrated mass spectrum of the products evolved from 40 to 250 s (corresponding to caprolactam production).

FIG. 9D show the time-resolved profile for m/z 97.

FIG. 9E shows the integrated product slate evolved from 320 to 550 s (corresponding to hydrocarbon products).

FIG. 27 shows the results of temperature-programmed pyrolysis of polycarbonate and ABS mixture with $Ca(OH)_2$ as a catalyst and steam as the carrier gas.

DETAILED DESCRIPTION OF THE INVENTION

Through the use of the invention, it has been generally discovered that, by the novel use of molecular beam mass spectrometry techniques applied to pyrolysis, a rapid detection of a wide range of decomposition products from polymers or plastics can be determined in real time in order to provide unique observations of the chemistry of pyrolysis and process conditions to produce high-value products. The observations or data of the analytical method of MBMS is then combined with other systems of data analysis in order to characterize complex reaction products and determine optimum levels of process parameters.

The results of MBMS applied to pyrolysis indicate that there are basically three methods of controlling the pyrolysis of synthetic polymers: (1) the utilization of the differential effect of temperature on the pyrolysis of different components; (2) the feasibility of performing acid and-base-catalyzed reactions in the pyrolysis environment to guide product distribution; and (3) the ability to modify reactions with specific added gaseous products generated in the pyrolysis of selected plastics.

Figure 1A:
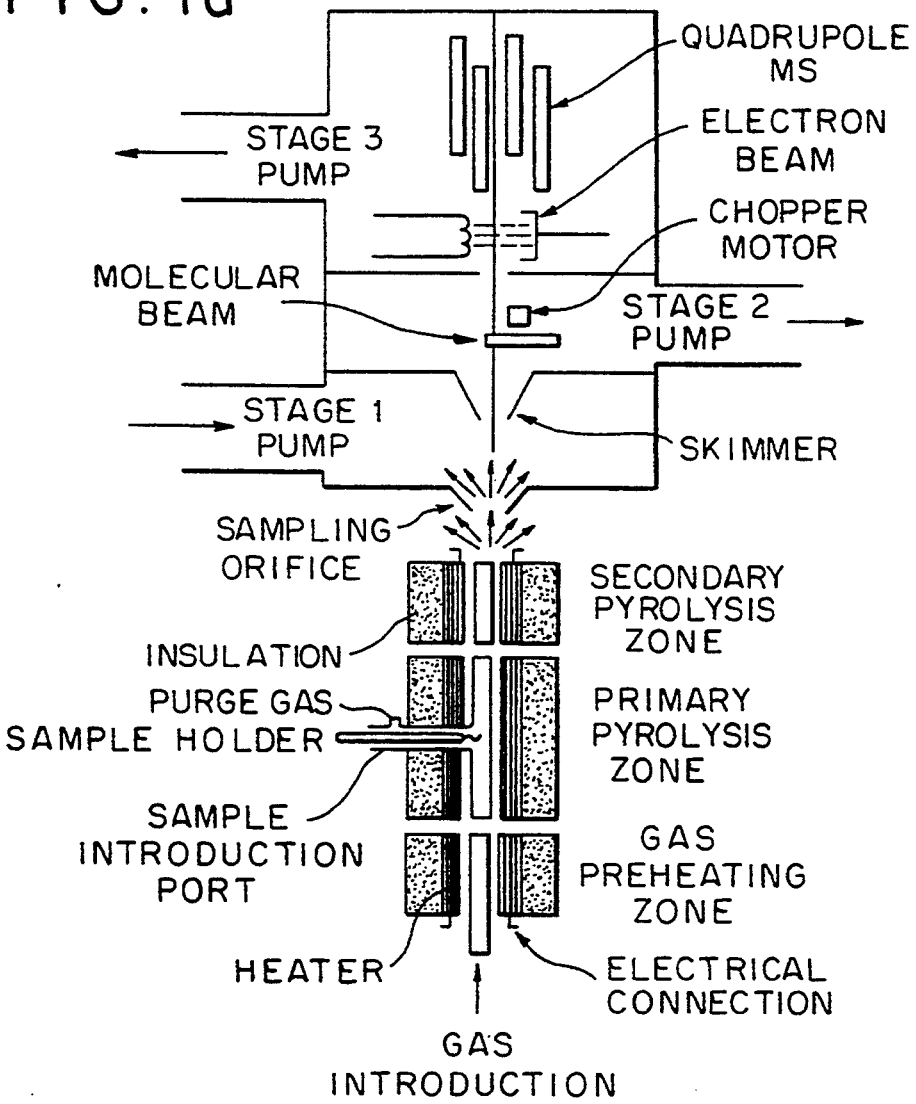
FIG. 1A is a schematic of the molecular beam mass spectrometer coupled to a tubular pyrolysis reactor used for screening experiments.

Pure plastics were individually pyrolyzed by introduction into flowing 615° C. helium, and the rates of product evolution are shown by the total ion current curves that are superimposed in FIG. 1A, where the product evolution curves for four of the major packing plastics are shown.

It is apparent that, even at this relatively high temperature, the times of peak product evolution for each polymer are resolved.

Thus, by use of a-controlled heating rate, resolution of the individual polymer pyrolysis products are possible, even from a complex mixed plastic waste stream. The nature of the individual plastic pyrolysis products using the condition obtained from MBMS is as follows:

By the use of the invention process, MBMS techniques can now be used to rapidly study the pyrolysis of the major components of a variety of industrial and municipal wastes stream to determine optimum methods for temperature-programmed, differential pyrolysis for selective product recovery.

Another aspect of the invention is that product composition can be controlled by the use of catalysts for the control of reaction products from pyrolysis and from hydrolysis reactions in the same reaction environment.

Despite the complex nature of the waste streams, it is apparent that evidence exists to enable the discovery and exploitation of the chemical pathways, and that it is possible to attain a significant level of time-dependent product selectivity through reaction control of the effect of these two process variables; namely, differential heating and catalytic pretreatment. Reactive gases can also aid in the promotion of specific reactions.

It is well known that the disposal of the residues, wastes, or scraps of plastic materials poses serious environmental problems.

Examples of these plastics include: polyvinylchloride (PVC), poly(vinyldene chloride), polyethylene (low-LDPE and high density HDPE), polypropylene (PP), polyurethane resins (PU), polyamides (e.g. nylon 6 or nylon 6,6), polystyrene (PS), poly(tetrafluoroethylene) (PTFE), phenolic resins, and increasing amounts of engineered plastics [such as polycarbonate (PC), polyphenyleneoxide (PPO), and polyphenylenesulfone (PPS)]. In addition to these plastics, elastomers are another large source of materials, such as tire scraps, which contain synthetic or natural rubbers, a variety of fillers and cross-linking agents. Wastes of these materials are also produced in the manufacturing plants.

These materials, amongst others, are widely used in packaging, electronics, interior decoration, automobile parts, insulation, recreational materials and many other applications.

These plastic materials are very durable, and their environmental disposal is done with difficulty because of their permanence in the environment. Their disposal in mass burning facilities confront environmental problems due to air emissions and this makes siting of these plants near urban and rural communities very difficult.

On the other hand, landfill is a poor alternative solution as the availability of land for such purposes becomes scarce and concerns over leachates and air emissions (methane) from these landfills poses serious doubts as to whether these traditional methods are good solutions to waste disposal.

The invention is premised on the recognition of the pyrolyric processes as applied to mixtures, in such a way, that by simultaneously programming the temperature (analytical language), or in multiple sequential stages of engineering reactors at different temperatures (applied language) by discovering the appropriate type of catalyst and reaction conditions, the mixture can generate high yields of specific monomeric or high value products from individual components of the mixed plastic stream in a sequential way, without the need to pre-sort the various plastic components.

In other words, substantial advantages of the invention are obtained by trading off the pre-sorting costs with those for the isolation of pyrolysis products and their purification from each individual reactor/condenser in the process.

The process of the invention is versatile and can be applied to a wide variety of plastic streams. Each stream requires the selection of specific conditions of temperature sequence, catalyst, and reaction conditions, such that the highest yields of single (or few) products can be obtained at each pyrolysis stage.

An example in the area of waste from consumer product manufacture is waste carpet, which includes nylon (6 or 6/6) and polypropylene. Polyesters are also components of a small fraction of the carpet area, particularly PET.

The recovery of the monomer, for instance, caprolactam from nylon-6 is obtained by pyrolysis at mild temperatures (near 300° C.) in the presence of selected catalysts (alumina, silica, and others in their basic forms, achieved by the addition of alkali/alkaline earth metal hydroxides to these catalysts). Nylon 6 pyrolysis can be separated from that of polypropylene(PP). PP pyrolysis can be directed to several end uses, as described above: aromatics, olefins and alkanes, process energy, and electricity. In this way, the production of a valuable monomer (caprolactam—the monomer for nylon 6) can be accomplished, the volume reduced, and energy co-produced, or other liquid fuels or chemical feedstocks.

A particular site where the equipment used in futherance of the process of the invention can be placed, is the "Carpet Capitol of the World" or Dalton-Whitfield County, Georgia.

One example of waste from consumer product manufacture subject to the invention process are the textiles manufacturing wastes. Waste from manufacture of recreational products are also subject to the process of the invention. Another major use of these technologies is for the recovery of value of monomer from the blends, which would be more difficult to recycle in other ways. Other examples of consumer product manufacture waste includes furniture manufacture, which uses textiles, fabrics and polyurethanes as foams for a variety of products. These waste would be suitable for conversion in the present process.

Other examples of products subject to the invention process are post-consumer wastes, which are separated at the source from paper and yard wastes, but not segregated by type of plastic. This stream represents all plastics that are used in households. The advantage is that sorting by individual types is replaced by the fractionation of individual products to be produced under conditions tailored for that mixture to recover the highest possible value or monomer. Present in this category are PET, PVC, HDPE, LDPE, PS and smaller amounts of other plastics. In this case, the process objective is to recover the monomer from PET as the terephthalic acid (TPA) or the corresponding methyl ester, in addition to low boiling point solvents. A key difference between this process and conventional hydrolysis or solvolysis of PET is that pyrolysis does not require a pure PET stream, and in fact, can utilize the PVC component to generate an acid catalyst for the process. The disadvantage compared to hydrolytic or solvolytic processes is less selectivity, but this is balanced by the ability to deal with more complex mixtures. This process would be most cost-effective in large mixed plastics processing streams.

Another example of products subject to the process of the invention are post-consumer waste such as autoshredder waste. The plastics used in this waste are polyurethane (PU, 26%), PP (15%); ABS (10%), PVC (10%) unsaturated polyester (10%), nylon (7.5%) and PE(6.5%), with smaller amounts of polycarbonate, thermoplastic polyesters, acrylic, polyacetal, phenolics, and others. PU pyrolysis can lead to monomers or to chemicals such as aniline and 4,4'-diamino-diphenyl methane, that are of high value. By the use of judicious catalyst combinations, and in the presence of steam and other reactive gases, one can optimize the production of specific compounds from the largest component of autoshredder waste. PVC's presence can be easily removed by the initial stage of pyrolysis of PVC at a much lower temperature to drive off the HCl, as is known in the prior art. PVC has been shown in the present invention however, to be useful in the pyrolysis of the thermoplastic polyesters present in the waste.

Sequential processes consisting of initial operation at low temperature with catalysts (e.g. base or other catalysts) may recover key monomers such as caprolactam, styrene, and low boiling solvents such as benzene. The initial pyrolysis can be followed by high temperature in the presence of steam, to convert the PU components into aniline or diamino-compounds or diisocyanate, The types of compounds and their proportions can be tailored by the operating conditions. Examples of suitable reactive media include amines such as ammonia, and other gases such as hydrogen. Support for the feasibility of such processes comes from the analytical area of pyrolysis as a method of determination of composition of composites, for instance, based on styrene copolymer, ABS-polycarbonate blends, as taught by V. M. Ryabikova, A. N. Zigel, G. S. Popova, Vysokomol. Soedin., Ser. A. vol. 32, number 4, pp. 882-7 (1990), and the various references mentioned above.

Wastes from the plastic manufacture on which the invention process is applicable are primarily those that involve blends and alloys, and off-spec materials, and a broad range of products and conditions are suitable in this regard. Examples of plastics include high value engineered plastics such as PC or PPO alone or in combination with PS or ABS (blends/alloys). Other examples include the wastes in production of thermosetting materials such as molded compounds using phenolic resins and other materials (e.g. epoxy resins), which would recover monomers and a rich char fraction.

Wastes containing polycarbonate, a high value engineered plastic, can produce high yields of bisphenol A, the monomer precursor of PC, phenol (precursor to bisphenol A) as well as 4-propenylphenol, by following the conditions prescribed in the invention. Other examples are phenolic resins, which produce phenol and cresols upon pyrolysis, in addition to chars. Other thermosetting resins can also be used to yield some volatile products, but mostly char, which can be used for process heat or other applications.

The invention will henceforth describe how to utilize detailed knowledge of the pyrolytic process in the presence of catalysts and as a function of temperature and the presence of reactive gases, to obtain high yields of monomers or valuable high value chemicals from mixtures of plastics in a sequential manner. The conditions were found experimentally, since it is not apparent which catalysts and conditions will favor specific pathways for the optimization of one specific thermal path, where several are available and the multicomponent mixture offers an increased number of thermal degradation pathways and opportunities for cross-reactions amongst components. In order to accomplish this, pyrolysis is carried out in the presence of appropriate catalysts and conditions at a low temperature to produce specific compounds (e.g. caprolactam from a nylon 6 waste stream; HCl from PVC to be collected or used as internal catalyst on mixed plastic streams; styrene from styrenic polymers); the temperature is then raised and a second product can be obtained [e.g. terephthalic acid from PET (present along with the PVC); bisphenol A from polycarbonate alone or in the presence of polystyrene]; finally, the PE or PP which are not substantially cleaved and can be burned to process heat, or upgraded into monomers known in the prior art, such that by addition of catalysts, such as metals on activated carbons, these compounds will be transformed either into aromatics or primarily olefins. The fate of the PE/PP fraction will depend on the specific location of the plant and of the need to obtain heat/electricity or chemicals to make a cost-effective operating plant.

Many types of reactors can be applied in the invention process, from fluidized beds to batch reactors, fed by extruders at moderate temperatures or other methods (dropping the plastic into the sand bath). Molten salts can also be used. The prior art contains substantial examples of the ability to operate and produce mixtures of products from pyrolysis of plastic wastes. Specific two-stage systems for pyrolysis at two different temperatures are disclosed in the patent literature but the goal was a fuel product.

The present invention makes the plastics recycling processes more cost-effective because it makes it possible to produce higher value products by tailoring the operation of the process.

DETAILED DESCRIPTION OF THE PREFERRED EMBODIMENTS

Types of equipment used 1) small-scale (5–50 mg sample) tubular reactor experiments that use batch samples and utilize a mass spectrometer for real time product analysis and allow the determination of reaction conditions; helium is used as a carrier gas for these types of experiments for analytical convenience, but is not claimed to be any different than other inert carrier gases such as nitrogen, carbon dioxide, and pyrolysis recycled gases.
2) bench-scale, stirred-autoclave reactor experiments that allow the determination of product yields and mass balances. The experiments used $<100$ g of plastics.

Simplified schematics of the molecular beam mass spectrometer (MBMS) coupled with a tubular pyrolysis reactor and the stirred autoclave are shown in FIGS.

1A and 2, respectively. The MBMS was used with a slide wire reactor shown in FIG. 1B to accomplish temperature-programmed pyrolysis in a batch mode of operation.

The following examples show the components of the process and how it can be applied to specific, mixed wastes with the production of high value materials by control of heating rate, co-reactants, and condensed-phase catalysts.

EXAMPLE 1

NYLON 6 AND POLYPROPYLENE MIXTURES AS OCCURS IN WASTE CARPETS ALSO APPLICABLE TO TEXTILE WASTES AND OTHER NYLON-6 CONTAINING WASTE STREAMS

Figure 3A:
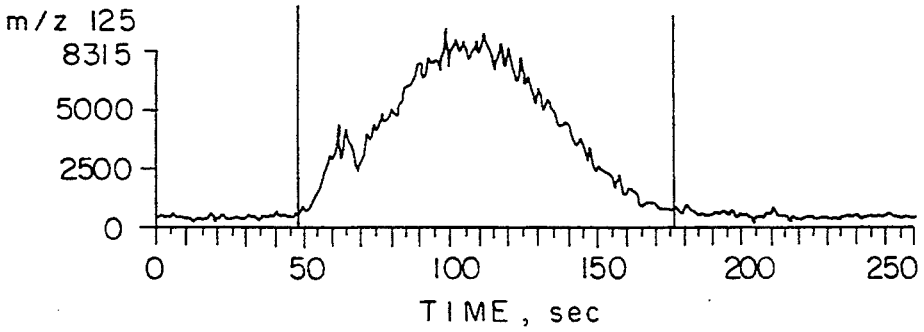
FIGS. 3A and 3B depict graphs of mass spectral analysis of the products of the pyrolysis of polypropylene.
Figure 3B:
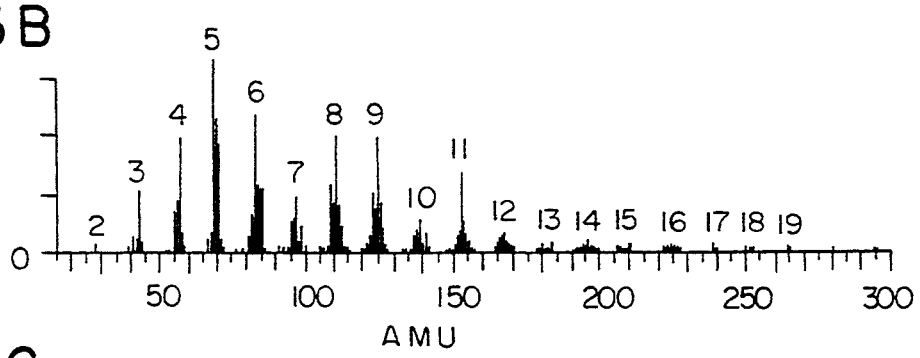

The mass spectral analysis of the pyrolysis of polypropylene at 509° C. in helium is shown in FIGS. 3A and 3B. The time-resolved profile of mass over charge of a specific ion, is represented as m/z 125. This ion is formed in the fragmentation of monoalkenes; the abscissa is time, and therefore, the plot shows the overall evolution of this ion as a function of time. The average spectrum shown in FIG. 3B can be compared to that for polyethylene in FIG. 11D for differences in product composition due to the different structure of polyolefins. The isoalkane backbone of polypropylene disfavors fragments with carbon numbers at 7 and 10.

Figure 3C:
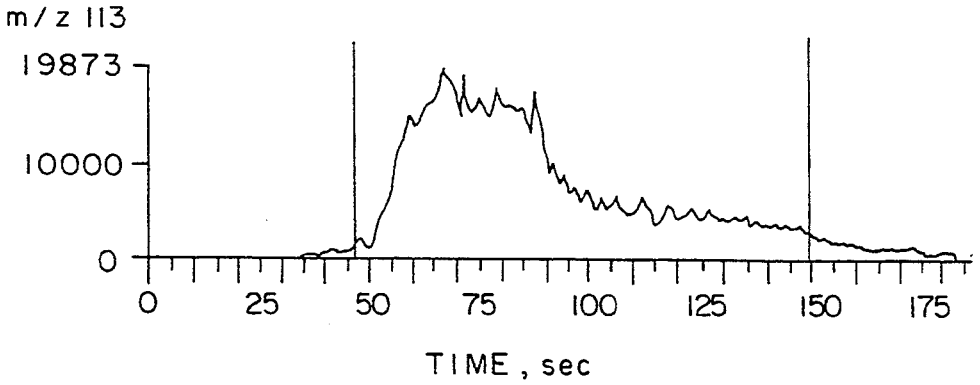
FIGS. 3C and 3D depict graphs of mass spectral analysis of the products of the pyrolysis of nylon 6.
Figure 3D:
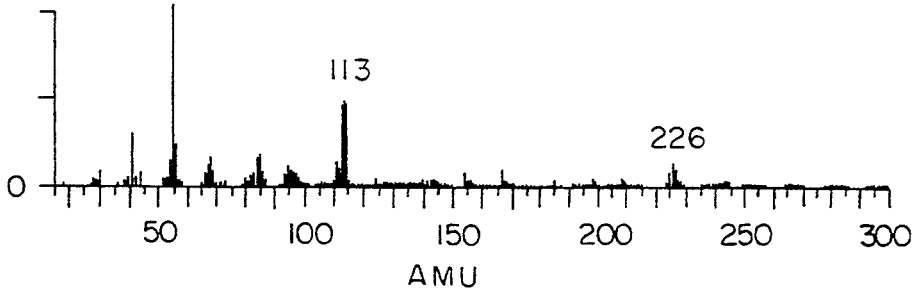
Figure 4A:
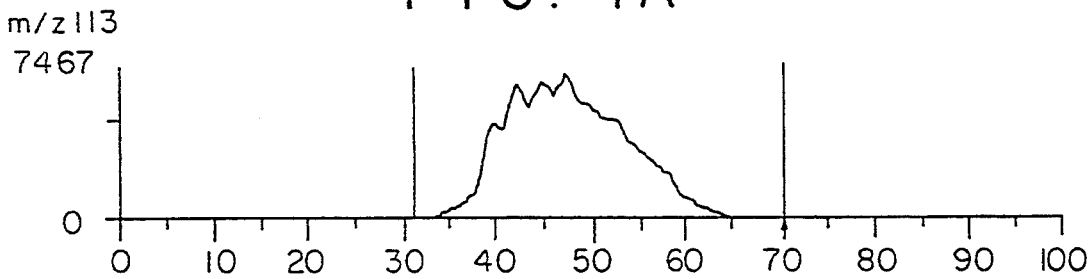
FIGS. 4A–4D depicts the overall results of straight pyrolysis at 520° C. without catalyst and in steam carrier gas of a mixture of nylon 6 and polypropylene.
Figure 4B:
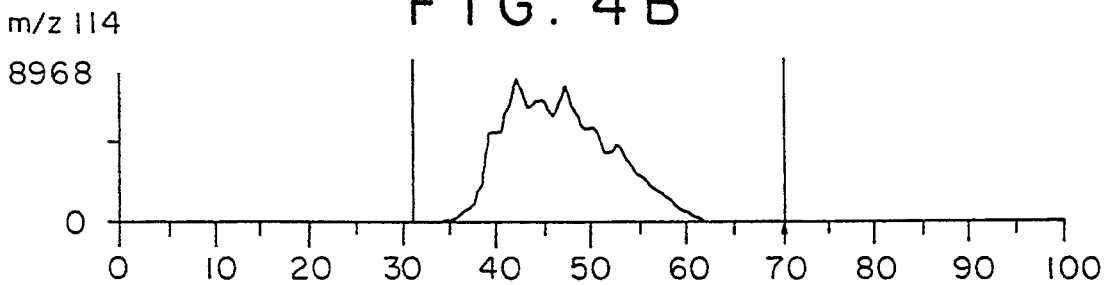
Figure 4C:
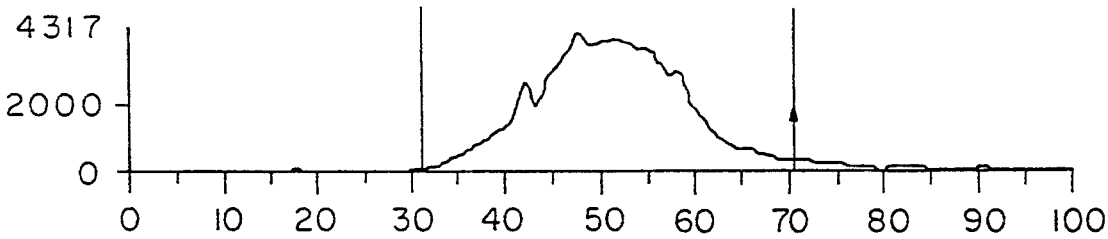
Figure 4D:
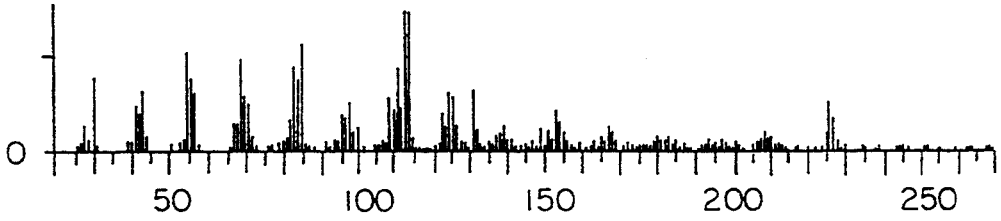

The mass spectral analysis of the pyrolysis of nylon 6 at 496° C. is shown in FIGS. 3C and D. The time-resolved profile of m/z 113, due to caprolactam, is shown in FIG. 3C and the averaged spectrum is shown in FIG. 3D. The ratio of m/z 113/114 is important since the m/z 113 intensity is due to the cyclic caprolactam monomer and the m/z 114 signal is due to a fragment ion of the dimer at m/z 226. Experiments with catalysts and in the presence of steam, described below, show the ability of affect this ratio. Therefore, m/z 113 is to be interpreted as the desired monomer caprolactam formation; the other product ion represents a dimeric structure that could also be used in repolymerization to nylon 6.

Nylon 6 can be pyrolyzed to give high yields of the monomer, caprolactam. FIG. 4 shows the time-resolved evolution profiles for caprolactam (m/z 113 in 4A) and m/z 114 (in FIG. 4B) both from nylon, and a characteristic ionization fragment ion of propylene-derived hydrocarbons at m/z 69 ($C_5H_9$+ FIG. 4C) with pyrolysis at 520° C. without catalyst. The peaks are overlapped and therefore the two products cannot be resolved. Furthermore, in this system, the presence of steam is deleterious since it leads to the cleavage of the lactam ring and an increase in the dimer products as shown in the integrated spectrum for the pyrolysis in FIG. 4D. This overlapping of products is present at all temperatures and hence simple pyrolysis will not affect separation of the components of the mixture.

Figure 5:
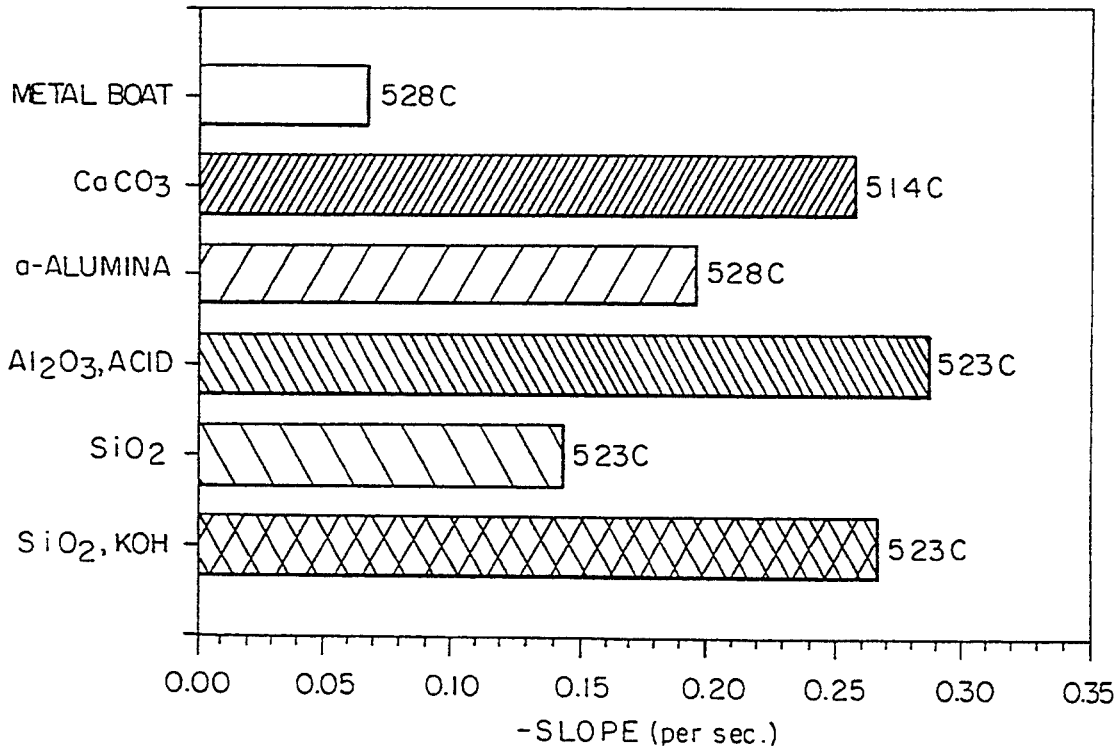
FIG. 5 shows the effect of various catalysts on the reaction rate for nylon 6.
Figure 6:
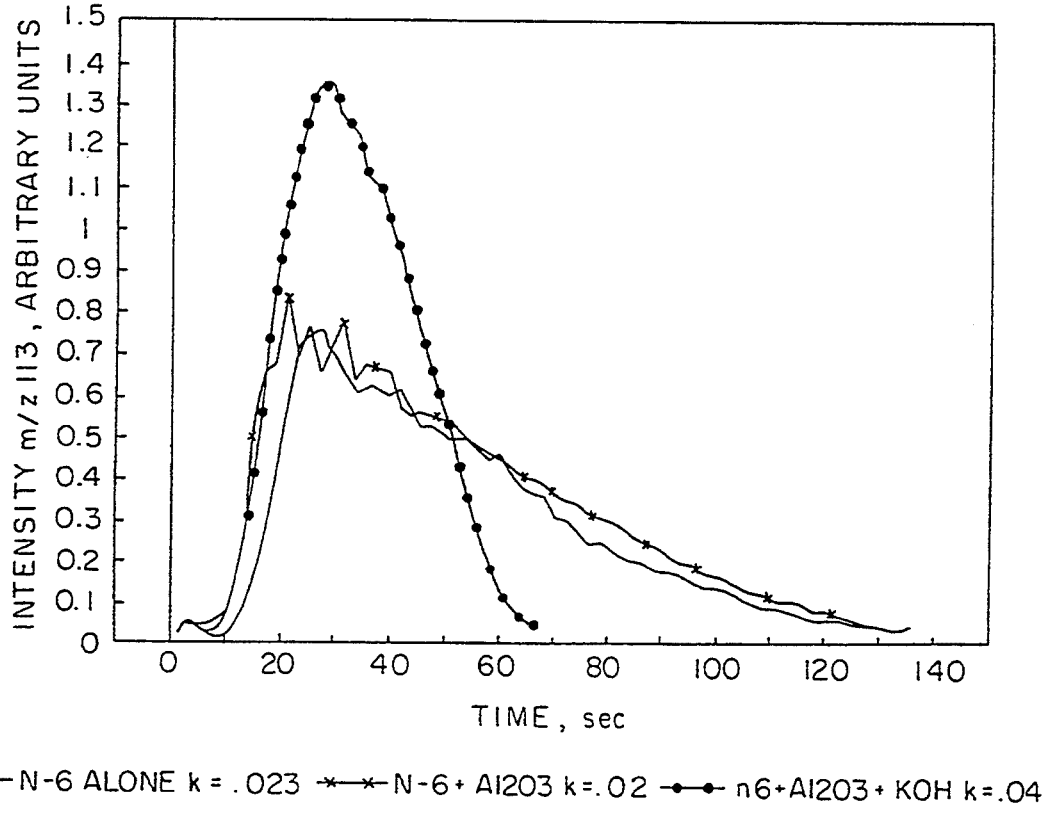
FIG. 6 depicts the evolution profiles for the pyrolysis of nylon 6 alone (—) and in the presence of $\alpha$-$Al_2O_3$ (—x—) and $\alpha$-$Al_2O_3$ treated with KOH (—•—) in flowing helium at 400° C.

A catalyst is therefore needed that would increase the rate of nylon 6 pyrolysis, and ideally increase the yield of caprolactam, but that would have no effect on PP pyrolysis. The effect of various catalysts on the reaction rate for nylon 6 are shown in FIG. 5. The rate constants were estimated by conventional graphical analysis of the integrated first order rate expression were a plot of In (C/Co) vs time, where the slope of the line is the rate constant. The shapes of the product evolution profiles for three key examples are shown in FIG. 6 for the formation of caprolactam at 400° C. from: nylon 6 alone, nylon 6 with $\alpha$-$Al_2O_3$, and $\alpha$-$Al_2O_3$ treated with KOH at the 1.5% level of addition (weight % KOH relative to the weight of nylon 6). These results show that the basic form of $\alpha$-$Al_2O_3$ increases the rate by a factor of two at this temperature. It is important to realize that, the addition of KOH or any other base in situ may be replaced by using a preformed aluminate.

Figure 7:
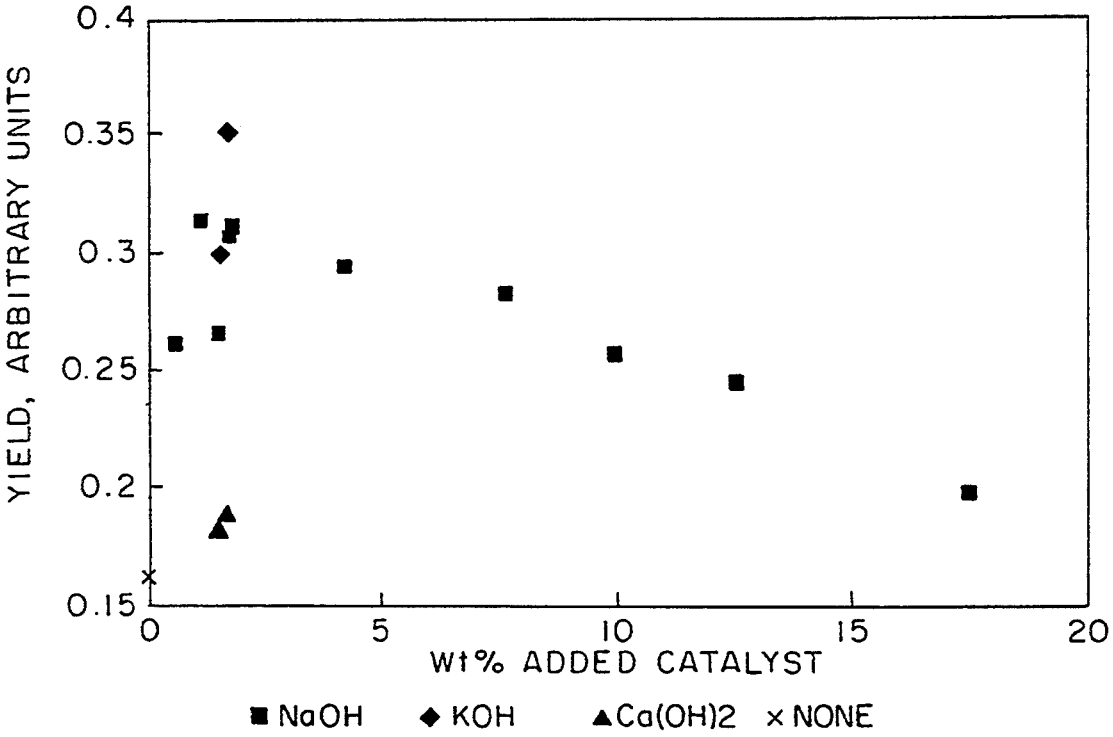
FIG. 7 shows the effect of catalyst on the yield of caprolactam from nylon 6 pyrolysis as a function of the amount of added catalyst for different catalysts.
Figure 8:
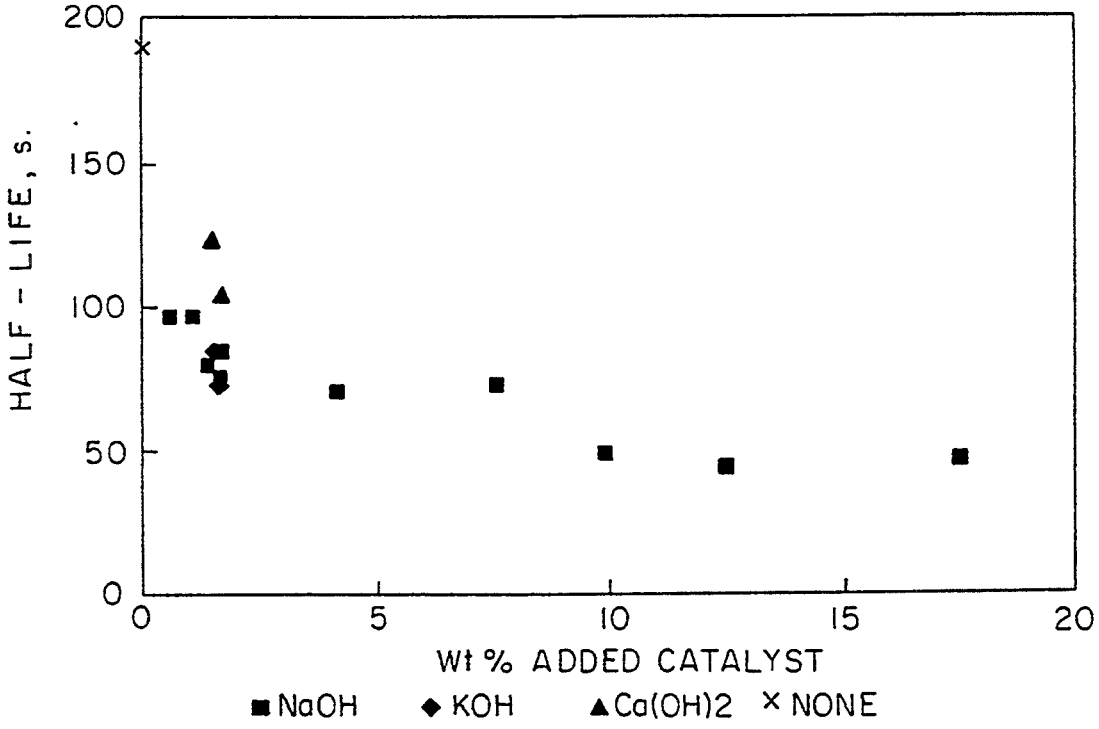
FIG. 8 shows the effect of catalyst on the rate of caprolactam formation from nylon 6 pyrolysis as a function of amount of added catalyst for different catalyst, where the rate is pressed as the half-life or the time for half the amount of caprolactam to form.

The level of addition and the nature of the caustic were further explored and the effect on yield and reaction rate are shown in FIGS. 7 and 8 respectively. FIG. 7 shows that NaOH is as effective as KOH, but that $Ca(OH)_2$ is much less effective. There appears to be an optimum catalyst concentration around 1–2% by weight and the yield decreases above this level. The reaction rates were calculated as the corresponding half-lives, or the time for half the amount of caprolactam to form. These measurements were made in the latter half of the pyrolysis pulse where heat transfer effects were of lesser importance. This parameter was plotted versus catalyst loading in FIG. 8 and shows the same trend noted for the yield estimates in FIG. 7 except at zero catalyst concentration in which case the yield is smallest and the half-life the highest. Estimates of the yield of caprolactam under the best conditions is 85% as investigated.

Under the best yield conditions, however, the caprolactam is not completely separated from the polypropylene products under isothermal conditions. Therefore the temperature programming is important in optimizing the production of caprolactam.

Figure 1B:
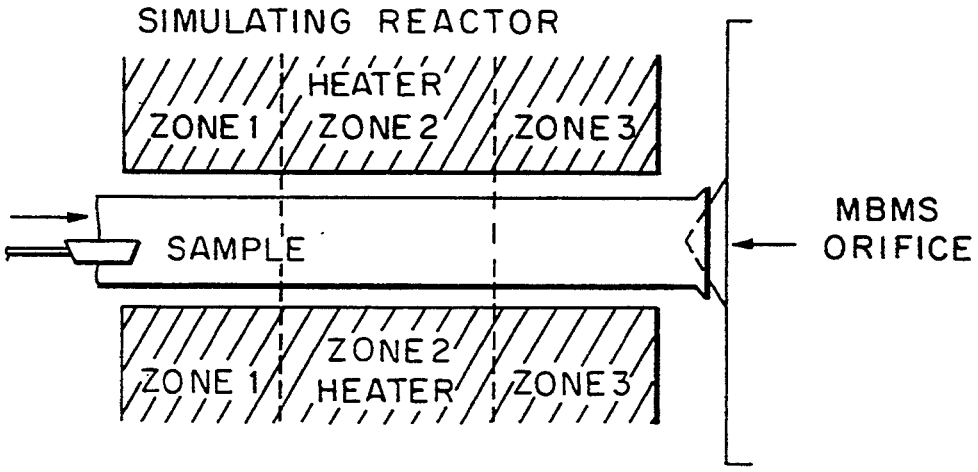
FIG. 1B is a schematic of the slide-wire pyrolysis reactor used to subject samples to batch, temperature-programmed pyrolysis.
Figure 9A:
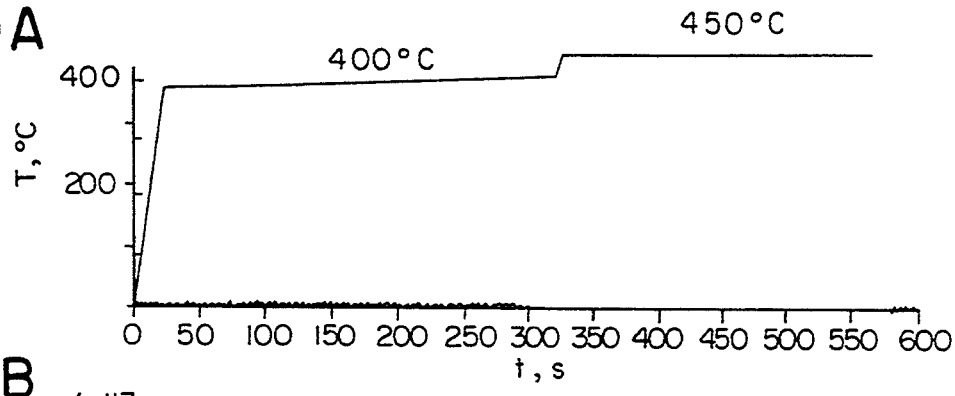
FIG. 9A–9E show the overall results from the temperature programmed pyrolysis of nylon 6 and polypropylene with KOH on $\alpha$-$Al_2O_3$ catalyst.
Figure 9B:
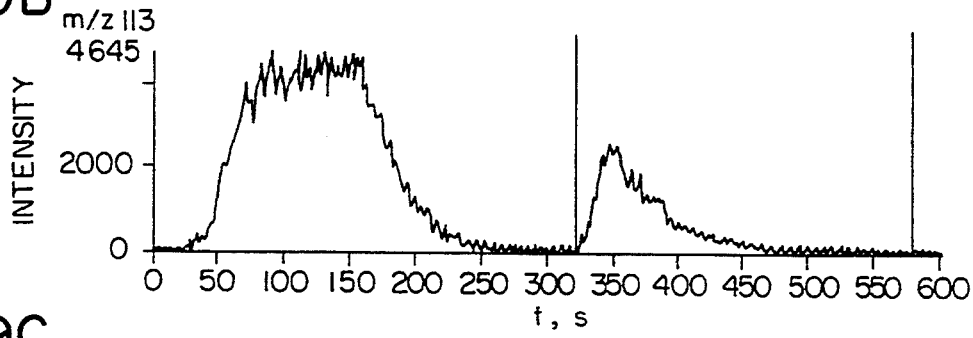
Figure 9C:
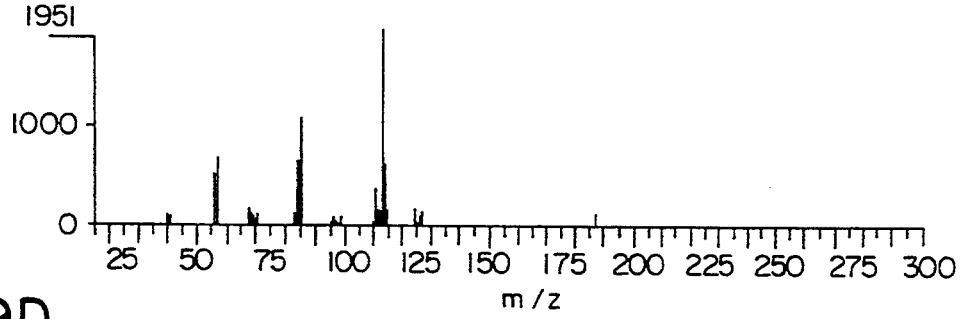
Figure 9D:
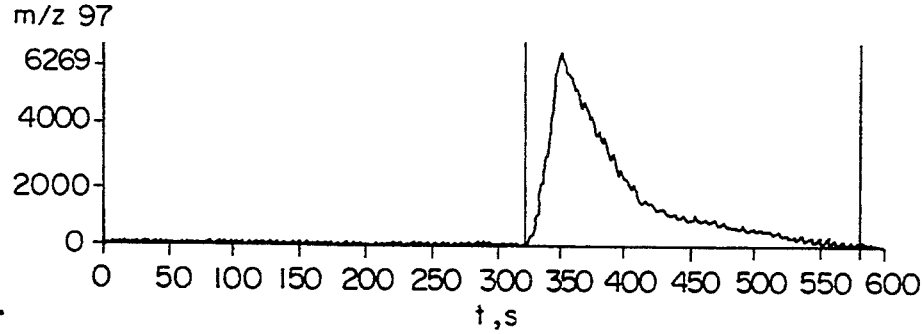
Figure 9E:
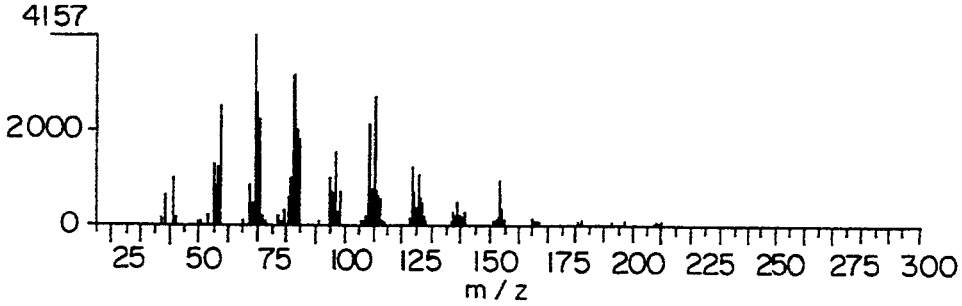

A mixture of nylon 6 and polypropylene (50/50 wt %) was treated with KOH on $\alpha$-$Al_2O_3$ and pyrolyzed without steam ant with a controlled heating rate from 400° to 450° C. using the slide wire reactor shown in FIG. 1B. The results from this run are shown in FIG. 9. The temperature trace is shown in FIG. 9A. FIG. 9B shows the time-resolved profile for m/z 113. The initial peak for m/z 113 (40–250s) is due to caprolactam and the integrated mass spectrum of the products for 40 to 250s is shown in FIG. 9C. Note the-lower abundance of m/z 114, 226 and other peaks compared to the uncatalyzed, higher temperature pyrolysis product spectrum shown in FIG. 3D. The polypropylene-derived products have the later evolution when the temperature has been ramped to 450° C. as shown by the second peak for m/z 113 in FIG. 9B due to the production of polypropylene-derived hydrocarbons exemplified by the product at m/z 97 shown in FIG. 9D. The integrated product slate from 320 to 550 s is shown in FIG. 9E, which is comparable to the spectrum shown in FIG. 3B.

FIG. 9 demonstrates the basic concept of the invention since both control of heating rate and the use of selective catalysis allow the recovery of a valuable monomer from a mixture of waste plastics; followed by the production of other chemicals from polypropylene, if desired.

Figure 2:
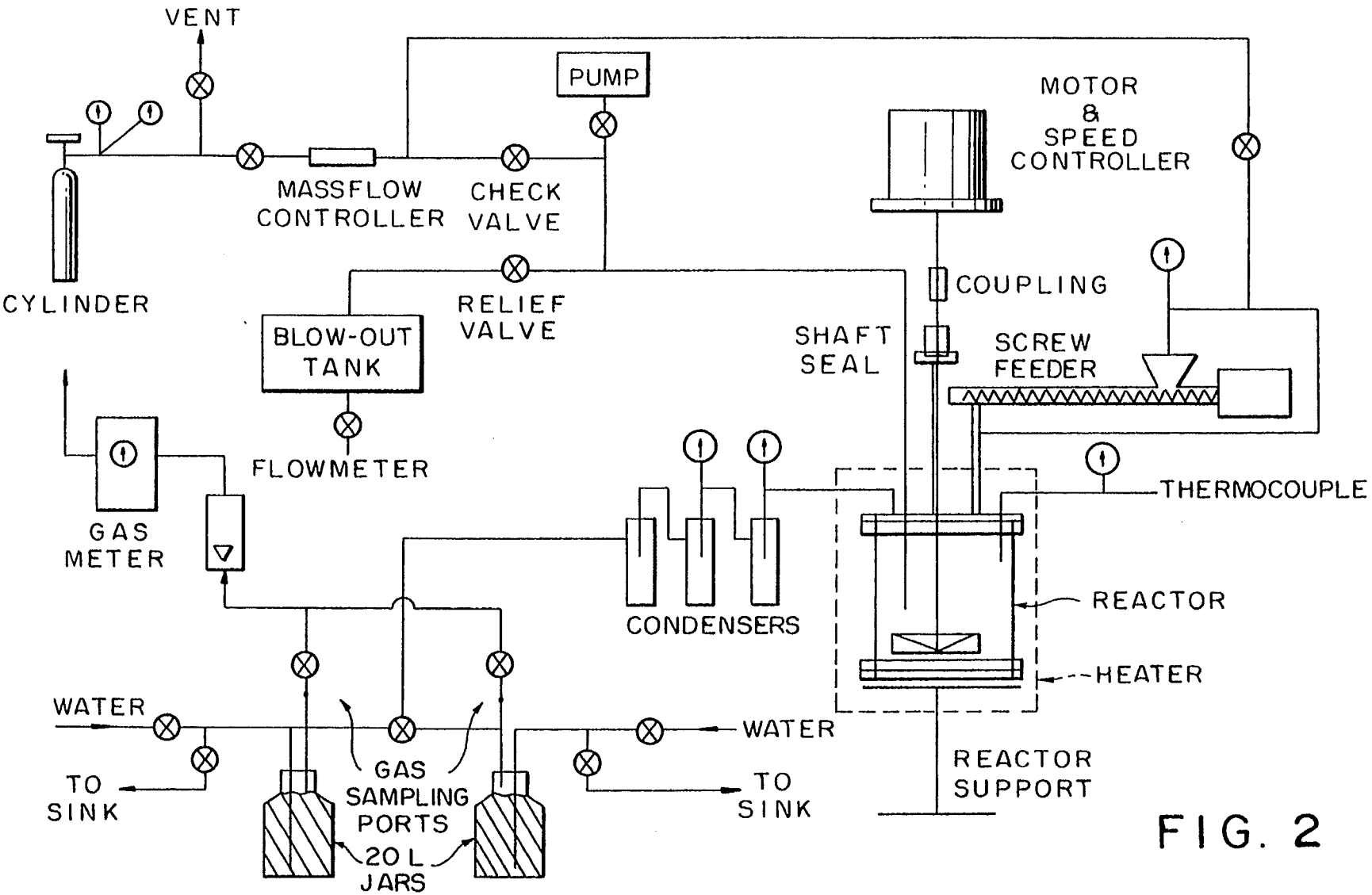
FIG. 2 is a schematic of the autoclave system used as a batch reactor for bench scale testing.

Bench scale experiments pyrolyzing nylon 6 and polypropylene alone or combined with polypropylene, or pyrolyzing carpet waste which also includes up to 10% dye, were performed using the apparatus shown in FIG. 2 and by introducing the sample prior to the heating.

A typical experiment (PR #6 in Table 2, which shows examples of plastics pyrolysis technologies to date) was performed by mixing 15 g of nylon 6 and 15 g of polypropylene and mixing with 10 g of $\alpha$-$Al_2O_3$ that had been treated with KOH so that the weight of KOH was 9 wt % of the alumina.

The reactor was heated at 40° C./min to a temperature of 293° C. which was held while the first set of products were collected. The temperature was then increased to 397° C. and a second set of products were collected. The breakdown of products for 4 runs is shown in Table 2 for the following conditions: polypropylene alone, no catalyst; nylon 6 alone, no catalyst; nylon 6 alone, with catalyst; and nylon 6 mixed with PP, and catalyst.

TABLE 2

Batch Bench-Scale Pyrolysis Experiments for Nylon 6 and Polypropylene Mixtures.
Temperatures were increased during the middle of run and separate product collections were made for each part, referred to as condition I and condition II. The mass entry is the condensible product collected under these conditions.

| Reaction #[a] | PR#3 | PR#4 | PR#5 | PR#6 |
|---|---|---|---|---|
| Input (g): | | | | |
| N-6 | 0 | 30 | 30 | 15 |
| PP | 20 | 0 | 0 | 15 |
| Catalyst: | no | no | KOH(9%) | KOH(9%) |
| $\alpha$-$Al_2O_3$ 10 g: | no | no | yes | yes |
| Mass Closure % | 69 | 89 | 98 | 96 |
| Product Distribution: (wt %) | | | | |
| Liquid/Solid | 67 | 86 | 83 | 85 |
| Gases | n/a | n/a | 4.6 | 4.9 |
| Char | 1.6 | 3.3 | 9.6 | 4.6 |
| Condition I: | | | | |
| Temp, °C. | 350 | 310 | 301 | 293 |
| mass, g | — | 26 | 25 | 9.8 |
| Condition II: | | | | |
| Temp, °C. | 442 | 392 | n/a | 397 |
| mass, g | 13 | — | — | 15.6 |
| Approximate yield of recovered Caprolactam, %: | nd | — | 85 | 66 |

[a]One experiment with nylon carpet was conducted. 15 g of carpet were pyrolyzed in the presence of $\alpha$-$Al_2O_3$ (20 g), which was treated with 0.32 g KOH and 14.8 of water. Mass closure was 83% of collected products (except gases). 20.3% of the products were liquid/solid and 35.5% were char/catalyst. The amount of caprolactam recovered from the liquid/solid fraction was 50%.

Figure 10A:
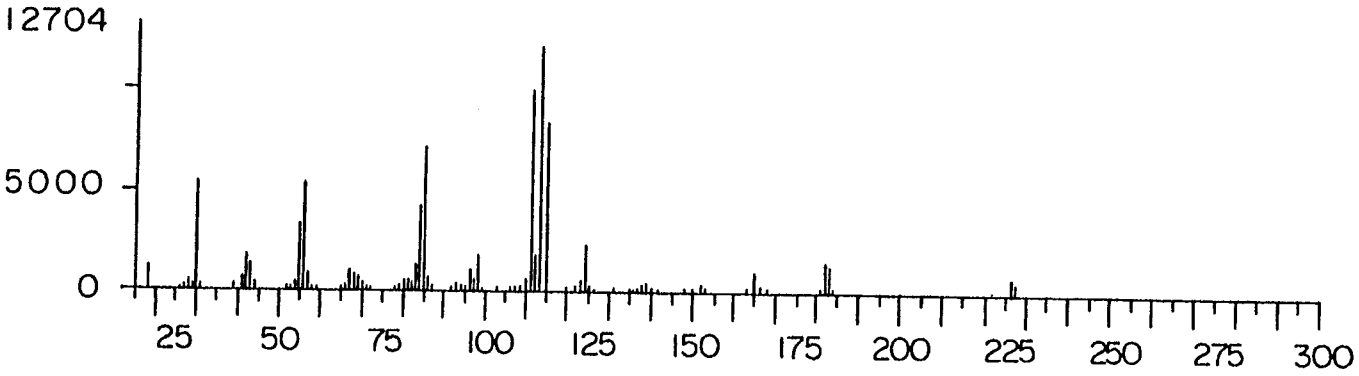
FIG. 10 shows the reaction products for the reaction of nylon 6 and polypropylene with KOH and $\alpha$-$Al_2O_3$ from a batch reactor showing the average spectrum, in (A) nylon 6, and (B) polypropylene.
Figure 10B:
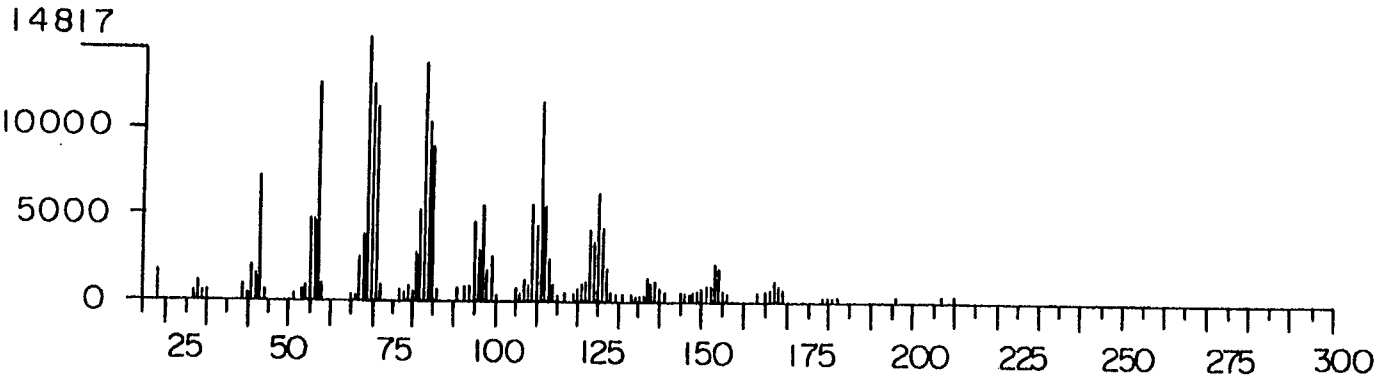

Mass closure was good in the range of 90–100% when gas analysis was performed. The key experiment is PR#6 which demonstrates the separation of the caprolactam in the first fraction with some carry over to the second fraction. Mass spectral analysis was performed on the liquid products from PR#6 and the results are shown in FIG. 10. The first fraction contains no PP products and caprolactam is the major product with some unsaturated product present at m/z 111 as well. The spectrum of the second fraction (FIG. 10*b*) is comparable to the polypropylene spectrum shown in FIG. 3B. These results translate into recovery yields of caprolactam of 85% and 66% for PR#5 and PR#6, respectively, where both experiments were carried out in a non-optimized way. Note the example using carpet waste which also produced caprolactam at 50% yield. These experiments were not optimized and illustrate the ability of the catalyst to facilitate nylon 6 pyrolysis to caprolactam at lower temperatures while not affecting polypropylene pyrolysis.

1) When the feedstock is carpet waste that includes nylon 6, or any waste stream containing nylon 6, and caprolactam is the desired product, the operative temperature conditions for sequential stages of pyrolysis to separate products are from about 250°–550° C. The preferred conditions are from 300°–450° C.
2) If the feedstock is waste carpet, textile or manufacturing waste containing polypropylene and the desired end products are hydrocarbons, the operative temperature conditions for sequential stages of pyrolysis to separate products are from about 350°–700° C; and preferably, from about 400° to 550° C.
3) While any acid or base catalysts may be used on waste containing nylon 6 and polypropylene, the preferred catalysts are NaOH, KOH, $Ca(OH)_2$, $NH_4OH$, alkali or alkaline earth oxides.
4) Supports which may be used in the pyrolysis of nylon 6 and polypropylene are oxides and carbonates; however, preferred supports are silica, alumina (all types) and $CaCO_3$; and
5) Carrier gases which may be used in the pyrolysis of nylon 6 and polypropylene are the inert gases, steam, $CO_2$ and process recycle gases; however, the preferred carrier gases are the inert gases, $CO_2$ and process recycle gases.

While the example detailed pertained to nylon 6, polycaprolactam, it is to be understood that, these catalysts, conditions, and reactive gases may be applied with small modifications to other lactam polymers of various chain lengths (i.e. 6, 8, 10, 12 . . . ).

EXAMPLE 2

POLY(ETHYLENETEREPHTHALATE) (PET) AND HIGH DENSITY POLYETHYLENE (HDPE) AS OCCURS IN MIXED WASTE PLASTIC BOTTLES AND OTHER WASTES FROM THE CONSUMPTION OF PLASTIC PRODUCTS OR FABRICATED PET PRODUCTS.

A common mixed plastic waste stream that is widely available is mixed plastic bottles. These are primarily of three types: PET, HDPE, and PVC. Current recycling efforts focus on either separating the bottles and reprocessing to lower value polymeric applications (e.g., PET fiber fill or carpet) or processing the mixed material to even lower value applications (e.g., plastic lumber). In this example, it will be shown how the main chemical starting materials of the constituent plastics can be efficiently reformed into high value chemical without prior separation of the plastics.

Figure 11A:
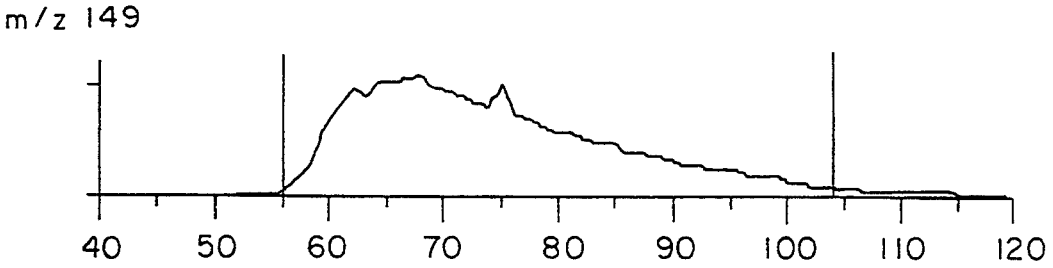
FIG. 11 shows overall spectral analysis of the products of the pyrolysis of poly(ethyleneterephthalate) (A and B) and polyethylene (C and D) performed individually. Poly(ethyleneterephthalate) was pyrolyzed at 504° C. in helium and the time-resole profile of m/z 149, a fragment ion of species with the phthalate structure is shown in (A) and the average spectrum over the time for the entire evolution of products is shown in (B). Polyethylene was pyrolyzed at 574° C. in helium and the time-resolved profile of m/z 97, a predominant fragment ion of the alkene series is shown in (C), while the average spectrum of the pyrolysis products is shown in (D).
Figure 11B:
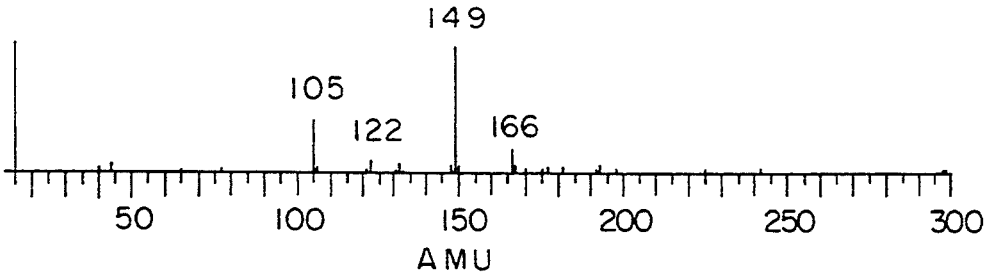
Figure 11C:
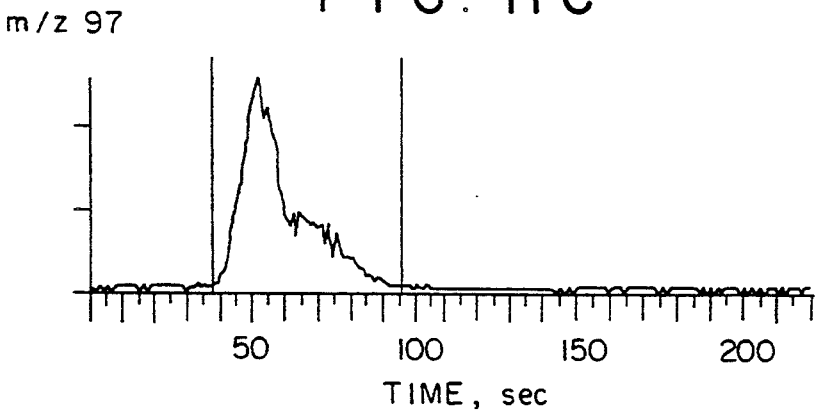
Figure 11D:
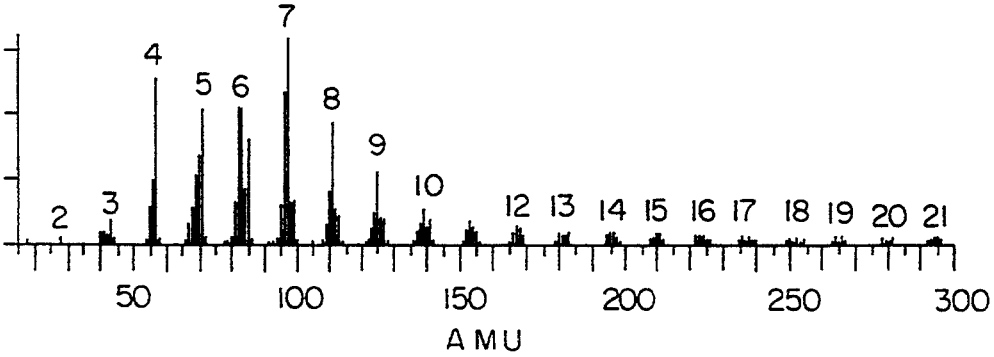

The mass spectral analysis of the pyrolysis of poly(ethyleneterephthalate) at 504° C. is shown in FIG. 11A and 11B. The time-resolved profile of m/z 149, a fragmentation ion of species with the phthalate structure, such as terephthalic acid (m/z 166), is shown in FIG. 11A and the average spectrum is shown in FIG. 11B for the entire evolution of products which show the lack of low molecular weight products, indicating that the ethylene unit remains attached to the aromatic moiety during pyrolysis. The mass spectral analysis of the pyrolysis of polyethylene at 574° C. in helium is shown in FIG. 11C and 11D. The time-resolved profile of m/z 97, a predominant fragmention of the alkene series (FIG. 11C) shows two sequential evolution rates which show different temperature dependencies. However, the average spectra of the early part, and the average spectra of the late part are nearly identical and the average over the whole evolution profile is shown in FIG. 11D. The numbers above the cluster of peaks refer to the number of carbon atoms present in the alkane, alkene and dialkene present in each cluster.

Figure 12A:
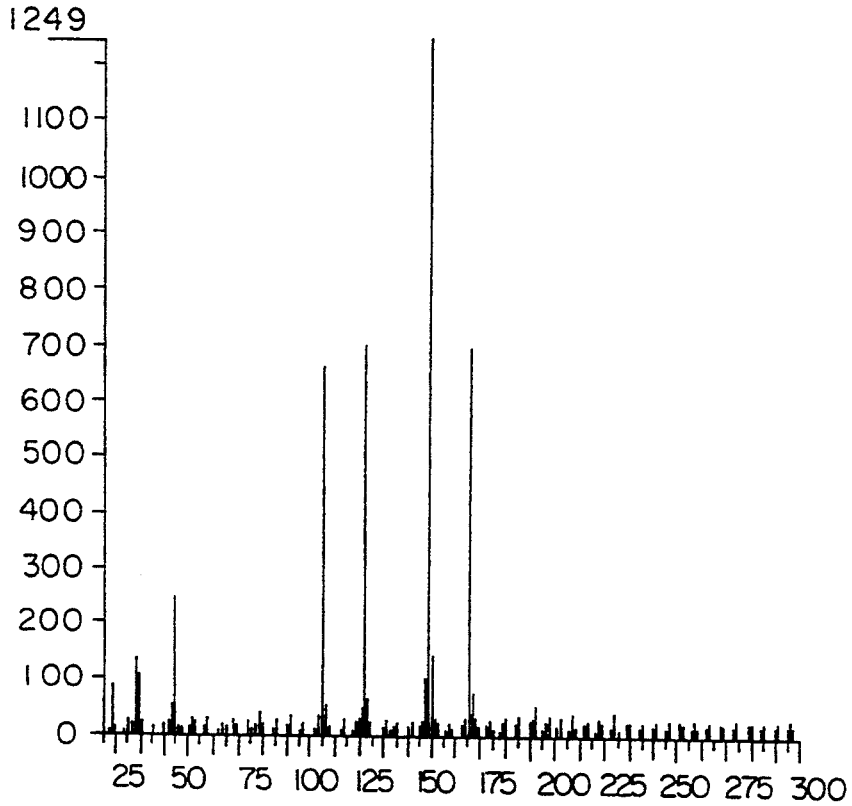
FIG. 12 shows the poly(ethyleneterephthalate) average pyrotysis spectrum without steam (A) and in the presence of steam (B).
Figure 12B:
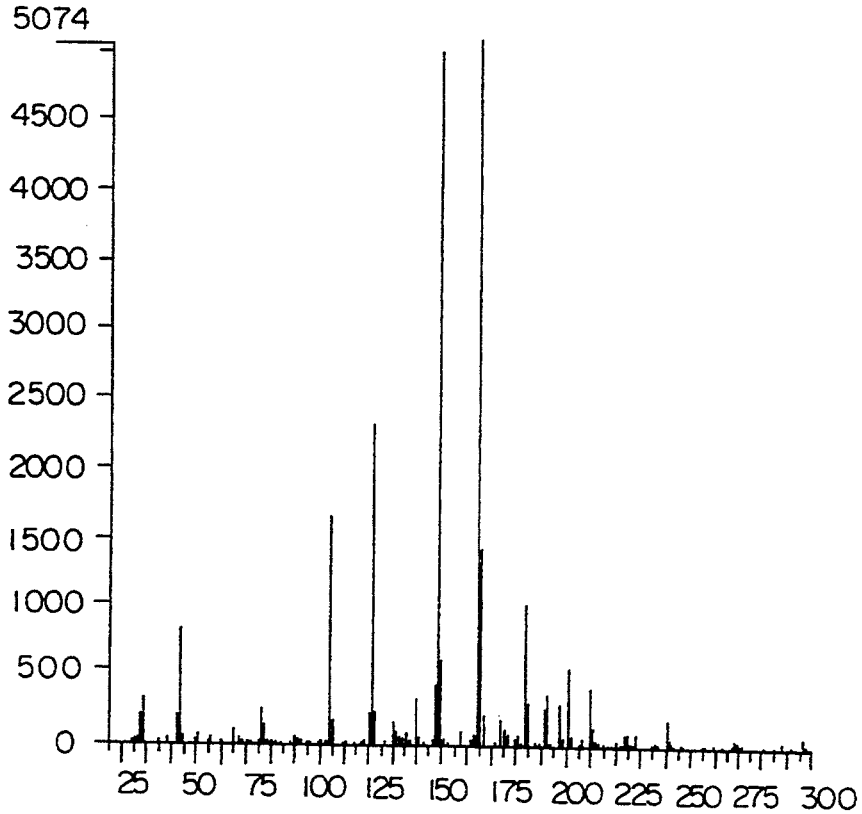
Figure 13:
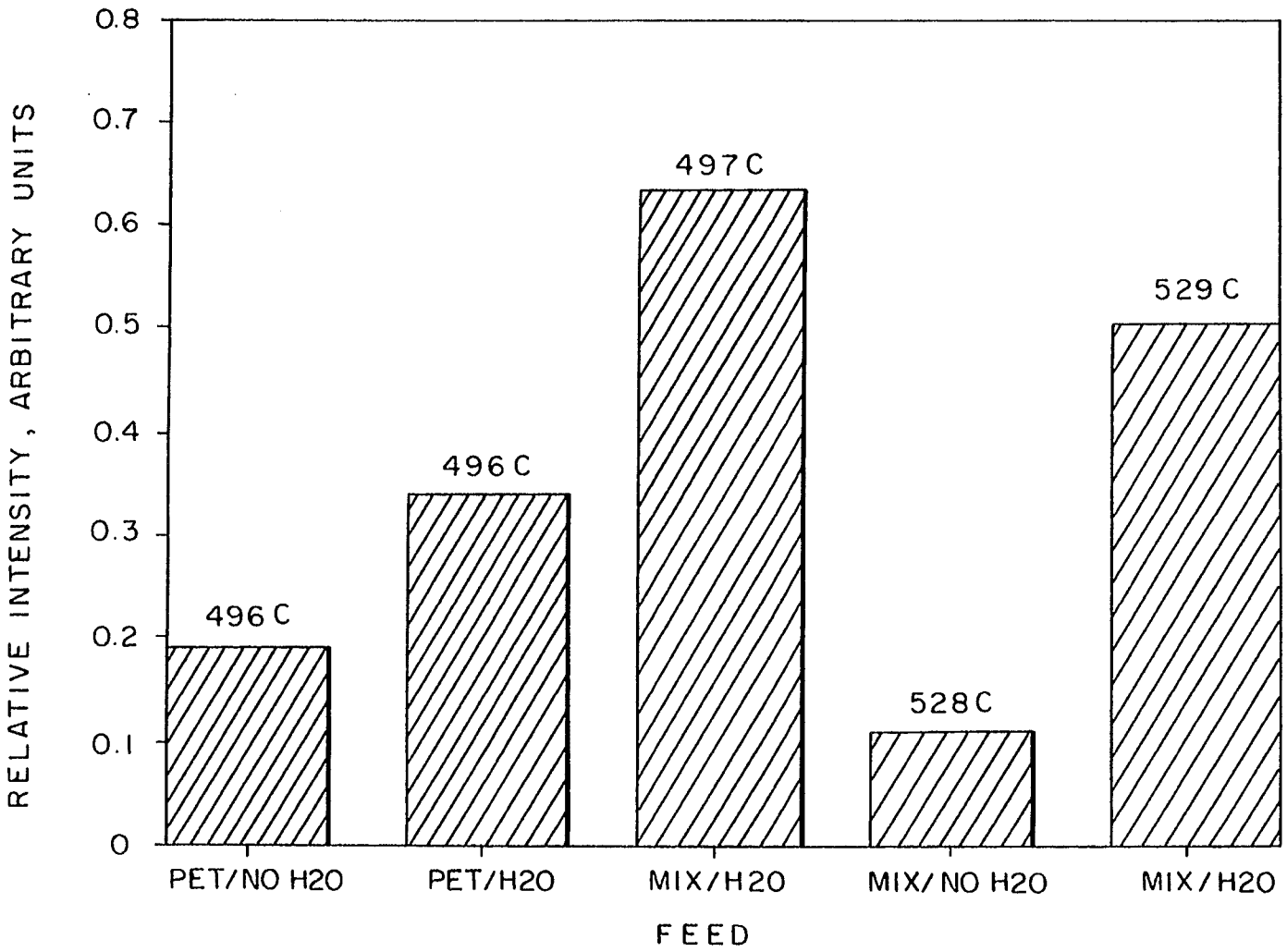
FIG. 13 shows the effect of conditions on terephthalic acid yields from poly(ethyleneterephthalate) pyrolysis in the presence or absence of steam and in the presence of polyvinyl chloride (labelled mix in figure), also in the presence or absence of steam.
Figure 14:
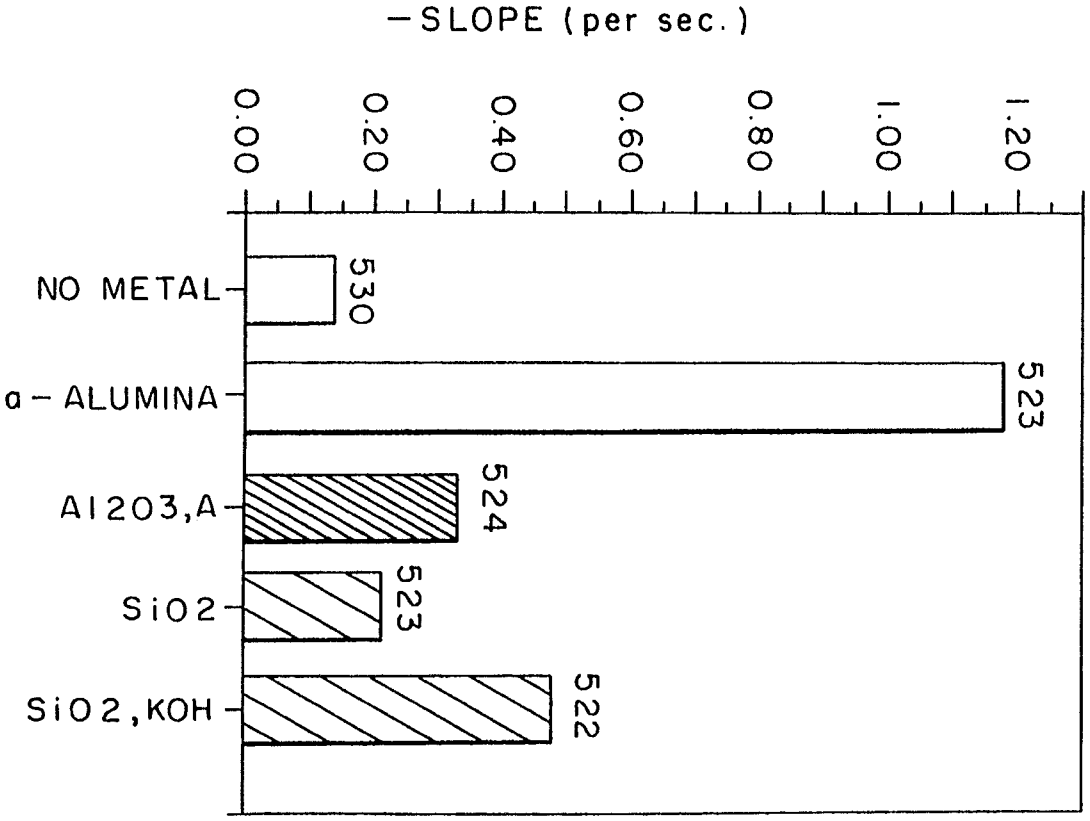
FIG. 14 shows the effect of various catalysts on the reaction rate for poly(ethyleneterephthalate).

PET was pyrolyzed with and without steam and the spectra of the products are shown in FIG. 12. The goal is to produce terephthalic acid (TPA) in high yield. The peak at m/z 166 is indicative of TPA while m/z 149 is a fragment ion that is due to several products, including TPA and its esters. The relative intensity of m/z 166 is a good indicator of the relative yield of TPA. By the use of steam as a co-reactant, the yield of TPA is increased as shown in FIG. 13. The yield is further enhanced by copyrolyzing PVC which generates HCl in situ (see FIG. 13, below) that catalyzes the hydrolysis of the ester linkage.

Figure 15A:
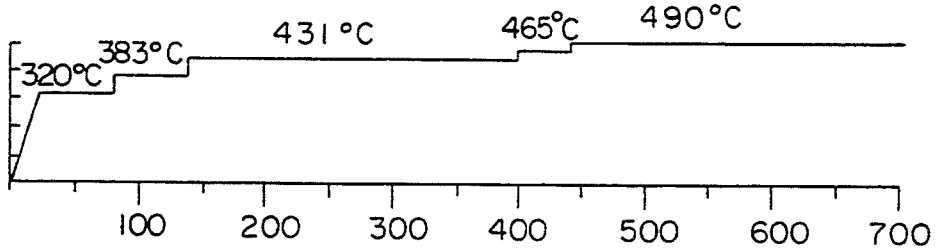
FIG. 15 shows the temperature programmed pyrolysis of a mixture of poly(ethyleneterephthalate) and high density polyethylene (HOPE) with $\alpha$-$Al_2O_3$ catalyst. The temperature is shown in (A); the time resolved evolution profile for the HDPE-derived products are shown in (B); the mass spectrum of the integrated product slate from 400 to 600s is shown in (C); the time-resolved evolution profile for the PET-derived products is shown in (D); and the mass spectrum of the integrated product slate from 150 to 300s is shown in (E).
Figure 15B:
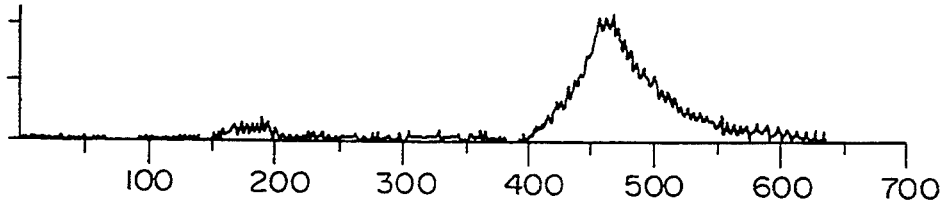
Figure 15C:
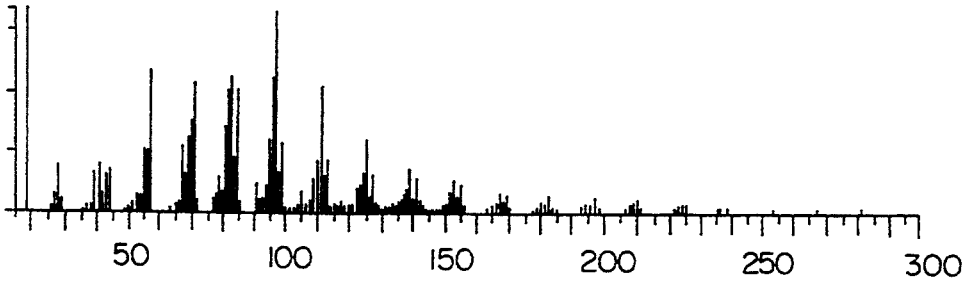
Figure 15D:
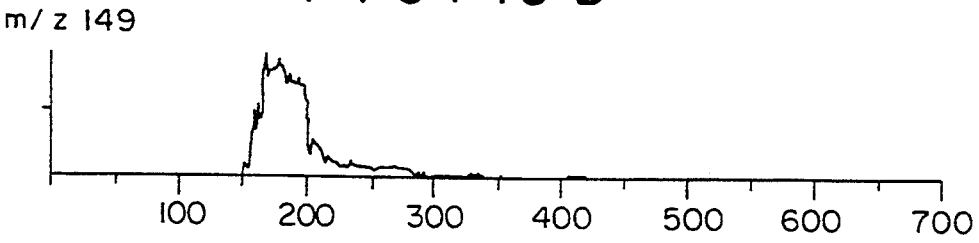
Figure 15E:
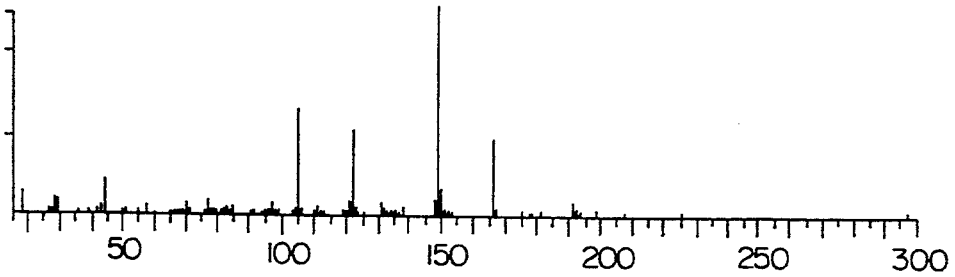

For the process to be useful, the production of TPA must be separated in time from the pyrolysis products produced from HDPE. As with Example 1, the use of catalysis speeds the reaction leading to TPA formation from PET, but does not affect the PE pyrolysis reaction. The effect of several additives are shown in FIG. 13. The use of temperature-programmed pyrolysis for a mixture of PET and HDPE with $\alpha$-$Al_2O_3$ catalyst is shown in FIG. 15. The temperature is shown in FIG. 15A, the time-resolved evolution profile for the HDPE-derived products in 15B, the mass spectrum of the integrated product slate from 400 to 600 s in FIG. 15C, the time-resolved evolution profile for the PET-derived products in FIG. 15D, and the mass spectrum of the integrated product slate from 150 to 300 s is in FIG. 15E.

While separation of the PET-derived products from the PE-derived products is possible under these conditions, high yields of TPA are not realized without the cofeeding of steam, as shown in FIG. 13.

Figure 16A:
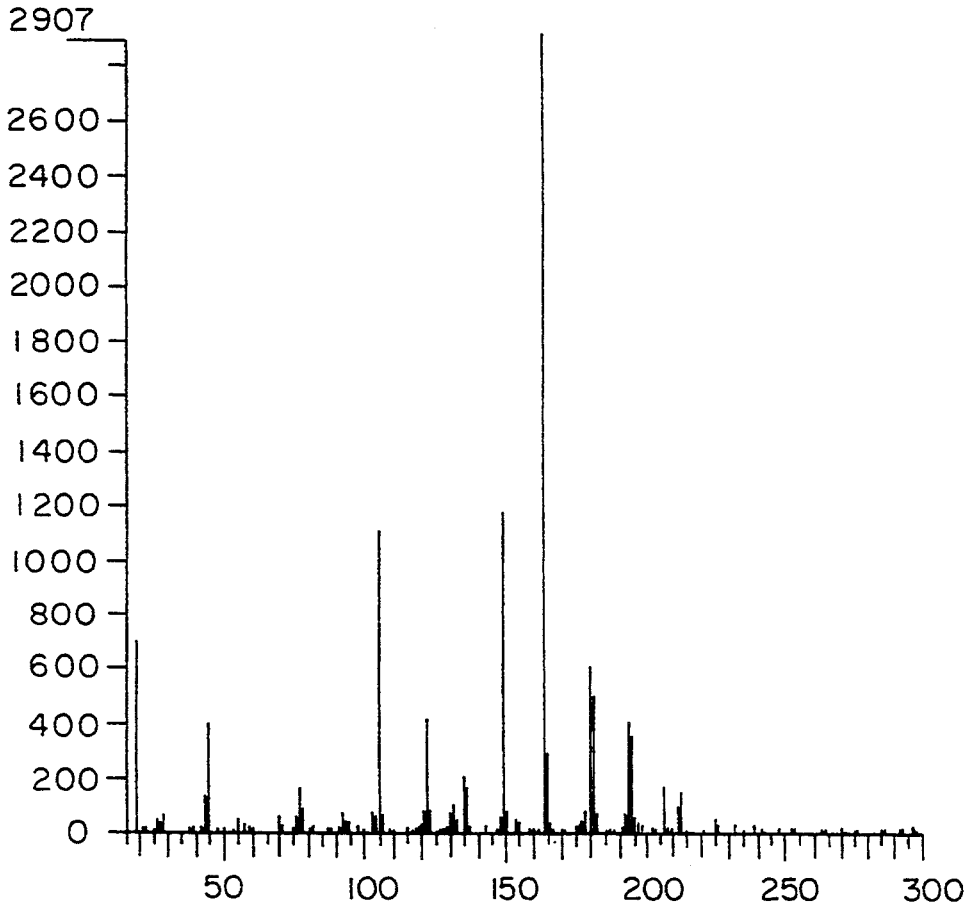
FIG. 16 shows the reaction products for the reaction of PET with methanol at 453° C.: showing the average spectrum in (A); the time-resolved profiles of the monomethyl ester of PET at m/z 180 in (B); and the dimethyl ester at m/z 194 in (C).
Figure 16B:
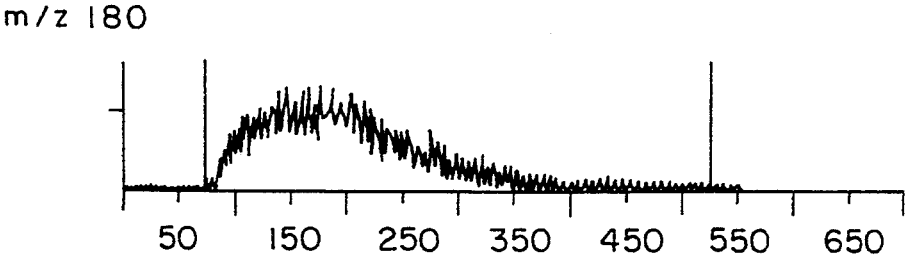
Figure 16C:
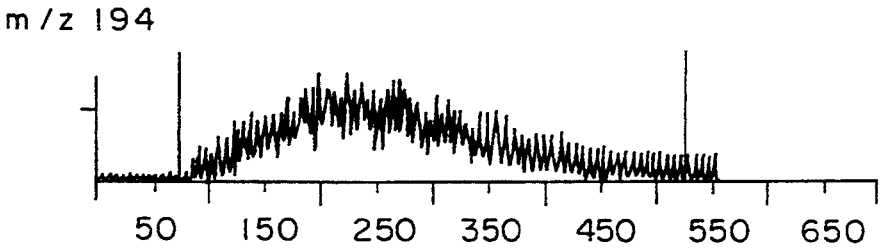
Figure 17A:
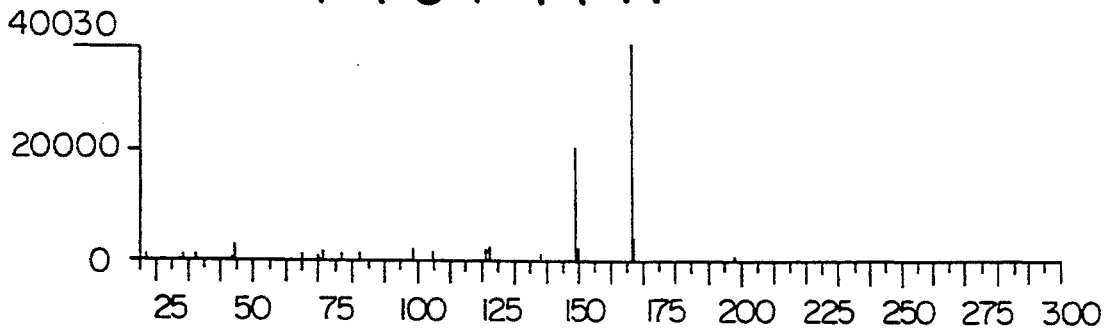
FIG. 17 shows the reaction products from a batch reactor, showing the average spectrum in: (A) PET-derived-material deposited on the wall of the reactor; (B) HDPE, (C) PET with steam collected in a condenser, and (D) PET with methanol added.
Figure 17B:
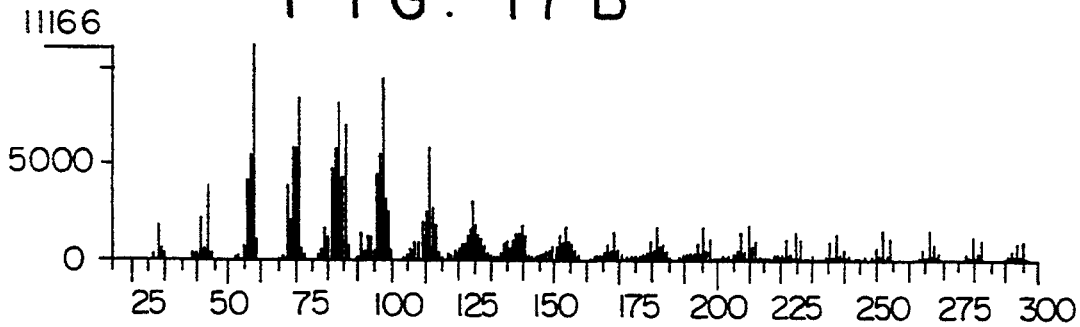
Figure 17C:
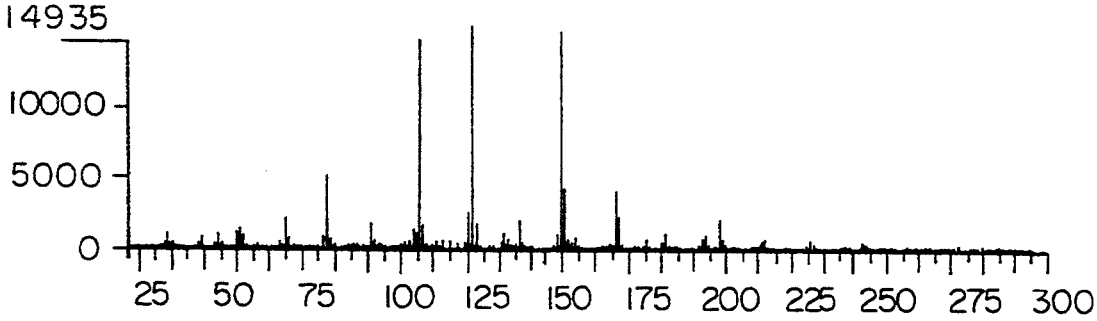
Figure 17D:
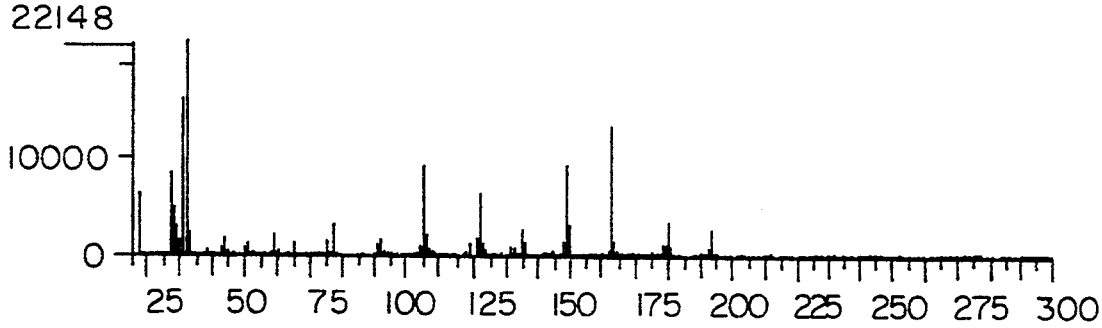

By using this reaction scheme, it is also possible to form the methyl ester of TPA by including methanol in the carrier gas as a coreactant and eliminating steam. The spectrum of reaction products for this reaction are shown in FIG. 16A which shows the appearance of the monomethyl (m/z 180) and dimethyl (m/z 194 esters of TPA.

Yields of TPA for the unoptimized steam/PET reaction are around 35 wt % and the yields of the monomethyl and dimethyl esters by cofeeding methanol are 15 and 5 wt %, respectively.

Similar MBMS results have been obtained with poly(butylene terephthalate), another polyester of interest in special applications.

Bench scale experiments of PET and polyethylene were performed in the same manner as described above for nylon 6. These bench-scale experiments demonstrate the benefits of cofeeding steam and methanol and validate the MBMS screening experiments described in this example. For instance, four runs are described in Table 3. They are: PR#7, HDPE alone, PR#9, PET alone; PR#12, PET alone with steam as a coreactant; PR#13, and PET alone with methanol as a coreactant.

It should be noted that PET fibers are also present in carpets and waste carpets as well as fiber fill in the presence of nylon and other plastic products.

These streams could also be converted into terephthalic acid or the esters in the pyrolysis process aided by steam or having methanol as a co-reactant.

TABLE 3

Batch Bench-Scale Pyrolysis Experiments for PET and PE. Temperatures were increased during the middle of run and separate product collections were made for each, referred to as conditions I and condition II. The mass entry is the condensible product collected under these conditions.

| Reaction # | PR#7 | PR#9 | PR#12 | PR#13 |
|---|---|---|---|---|
| Input (g): | | | | |
| PET | 0 | 20 | 20 | 20 |
| HDPE | 20 | 0 | 0 | 0 |
| Coreactant: | none | none | H20 | MEOH |
| Mass Closure % | 96 | 71 | 81 | 86 |
| Product Distribution (wt %) | | | | |
| Liquid/Solid | 85 | 36 | 42 | 57 |
| Gases | 5.7 | 20 | 17 | 15 |
| Char | 0.3 | 16 | 23 | 14 |
| Conditions: | | | | |
| Temp, °C. | 443 | 492 | 453 | 453 |
| mass 1, g | 16 | 4.2 | 4.1 | 4.7 |
| mass 2, g | 1 | 3.1 | 4.3 | 6.7 |
| Approximate Yield of Recovered Products, %: | 85 | 37 | 42 | 57[a] |

[a]Yield of this product includes the incorporation of methanol to form the ester products.

The reactor was heated at 40° C./min to a hold temperature that ranged from 443° to 492° C. for the different experiments and products and were collected in two condensers. The breakdown of products shown in Table 3 shows mass closures that are around 80% for PET and 95% for HDPE. The low mass closures for the PET are due to the low solubility and low volatility of terephthalic acid, which complicates the physical recovery from transfer lines where it tended to accumulate in the small batch reactor in which these reactions were carried out, and it was difficult to close mass balance better. However, larger scale experiments or industrial scale equipment would not be subject to this limitation.

Mass spectral analysis was performed on the liquid products and the spectra of selected product fractions are shown in FIG. 17. The straight pyrolysis of PET (PR#9) shows high yields of TPA as shown in FIG. 17A. The spectrum of the collected pyrolyzate from PE pyrolysis (PR#7) is shown in FIG. 17B. The spectrum shown in FIG. 17C is a subfraction from PR#12 that shows the presence of other products, most notably benzoic acid, (m/z 122 and fragment ion 105). Note that benzoic acid itself would be a desired high value product that one could optimize from this process. The formation of methyl esters of TPA when methanol is cofed in the gas phase (PR#13) is shown in FIG. 17D with added peaks at m/z 180, due to the monoester, and m/z 194, due to the diester.

These experiments indicate that pyrolysis is an alternative to solvolysis/hydrolysis, when it is unavoidable that mixtures with other polymers will be present. Of particular importance is that, while the presence of PVC is detrimental to any hydrolyric or solvolytic process, which require pure streams, in the case of pyrolysis as described in the present invention, the PVC acts as a catalyst.

The results show that temperature-programming, catalysts and co-reactant gases can be judiciously selected to deal with complex mixtures of plastics to recover monomer value or chemicals, in addition to energy value.

While the examples above employed PET as a waste plastic component, it is to be understood that similar polyesters with longer chain lengths may be pyrolyzed under controlled conditions in the presence of reactive gases (steam or methanol) to lead to recoverable aromatic monomers (e.g. PBT or polybutyleneterephthalate).

Another extension of the invention is that, because of the behavior of other condensation polymers such as polyhexamethylene adipamide (nylon 6,6) and other combinations of numbers of carbon atoms (nylon 6, 10, etc.) in the presence of reactive gases such as steam in the presence of catalysts (e.g. HCl from PVC), the process can lead to the formation of adipic acid/ester or lactane, depending on the selected conditions. The recovery of the diamines is also possible (see polyurethane example in which aniline derivative is obtained).

The conditions under which PET and PE contained in waste mixed bottles, carpet waste and textile and manufacturing waste are pyrolyzed, are as follows:

| Feedstock | Conditions* | Preferred | Products |
|---|---|---|---|
| PET | Temp1: 250–550 | 300–450 | Terephthaic Acid Benzoic Acid, Esters of TPA |
| PE as in: waste mixed bottles, PET carpet waste, textile and manufacturing waste | Temp2: 350–700 | 400–550 | hydrocarbons |
| | Catalysts: acid or base catalysts | $\alpha$-$Al_2O_3$ $SiO_2$, KOH, PVC | |
| | Supports: oxides and carbonates | $SiO_2$, $Al_2O_3$ | |
| | Carrier Gas: inert gases, steam, $CO_2$, process recycle gases, methanol | steam methanol[1] | |

*Temperatures are for sequential stages of pyrolysis to separate products.
[1]Preferred conditions depend on desired products.

EXAMPLE 3

MIXED, POST-CONSUMER RESIDENTIAL WASTE

A major source of mixed-waste plastics will be source-separated, residential, waste plastics. This material is mostly polyethylene and polystyrene with smaller amounts of polypropylene, polyvinylchloride and other plastics. A simple process to deal with this material will be shown and the process gives high yields of aliphatic hydrocarbons and styrene in separate fractions with minimal impact from the other possible materials.

Figure 18A:
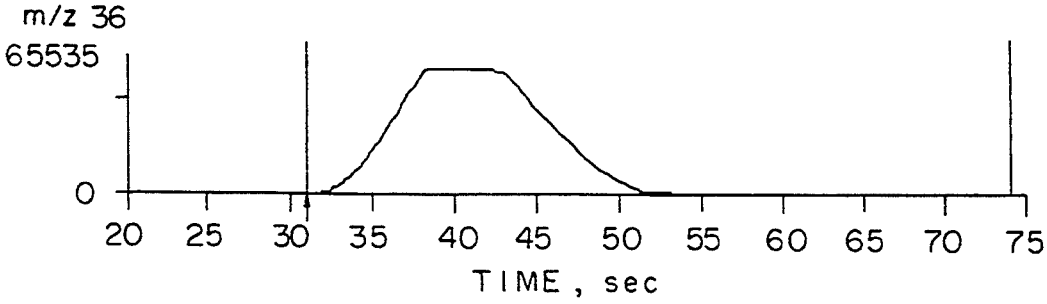
FIG. 18 shows mass-spectral analysis of the products of the pyrolysis of polyvinylchloride (A and B) and polystyrene (C and D) performed individually. Polyvinylchloride is pyrolyzed at 504° C. in helium and the time-resolved profile of m/z 36, due to HCl, is shown in (A) and the average spectrum over the time for the entire evolution of products is shown in (B): Polystyrene is pyrolyzed at 506° C. in helium and the time-resolved profile of m/z 104, due to styrene, is shown in (C) and the average spectrum over the time for the entire evolution of products is shown in (D).
Figure 18B:
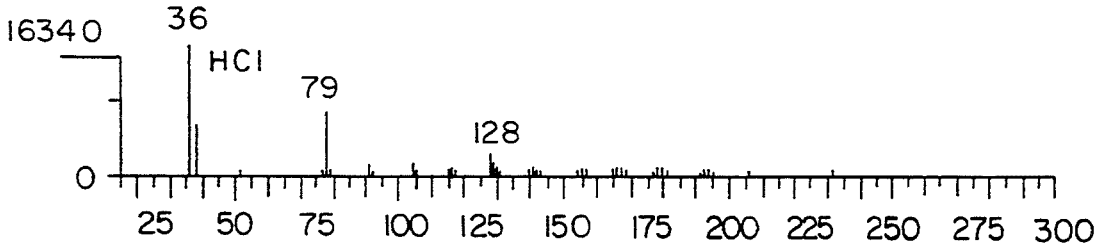
Figure 18C:
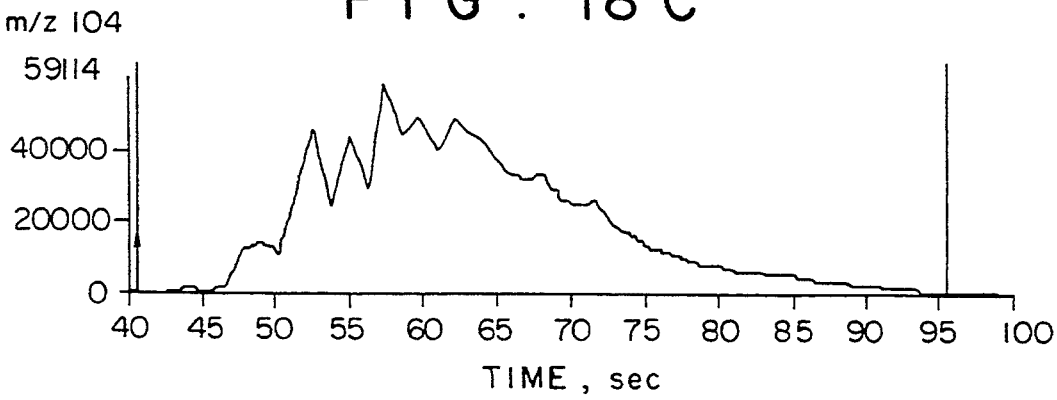
Figure 18D:
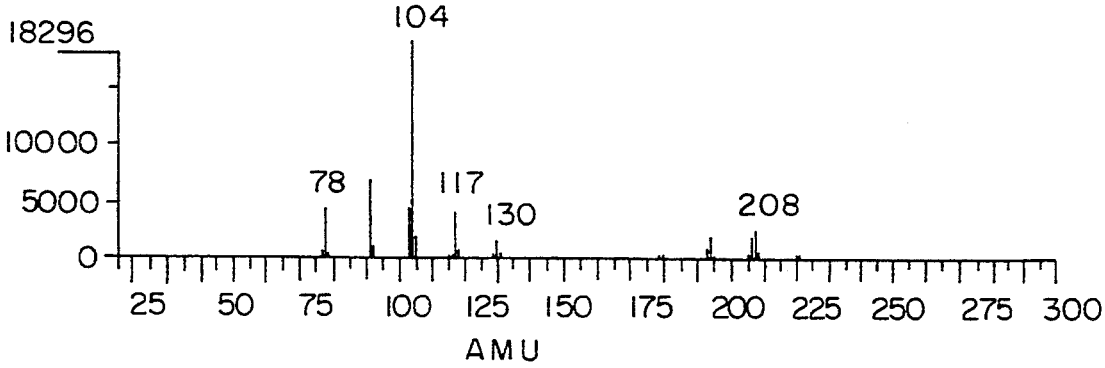
Figure 19A:
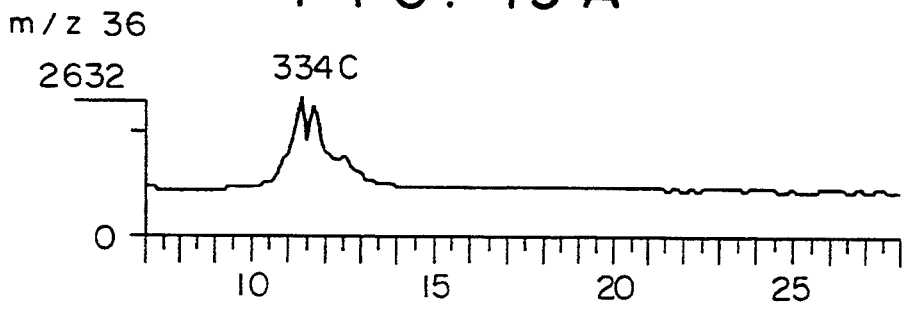
FIG. 19 shows the time-resolved evolution curves of the major pyrolysis products of a synthetic mixture of polyvinyl chloride (PVC), poly(ethyleneterephthalate) (PET), polyethylene (PE) and the polystyrene (PS) pyrolyzed under slow heating conditions of approximately 40° C./minute with no catalytic addition. Terephthalic acid is the first peak in m/z 149 trace, styrene is m/z 104, HCl is m/z 36 and hydrocarbons from PE are represented by m/z 97.
Figure 19B:
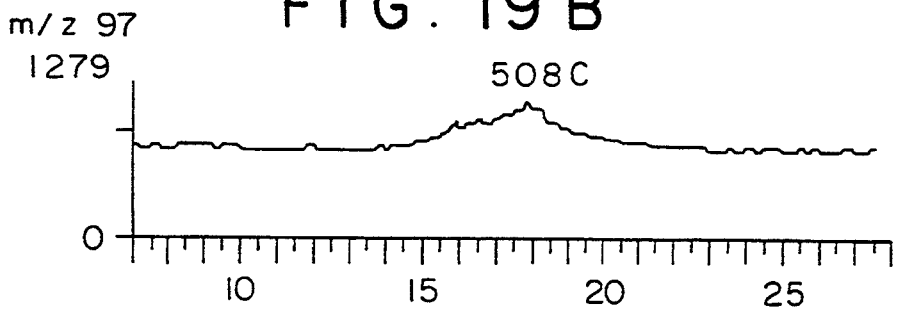
Figure 19C:
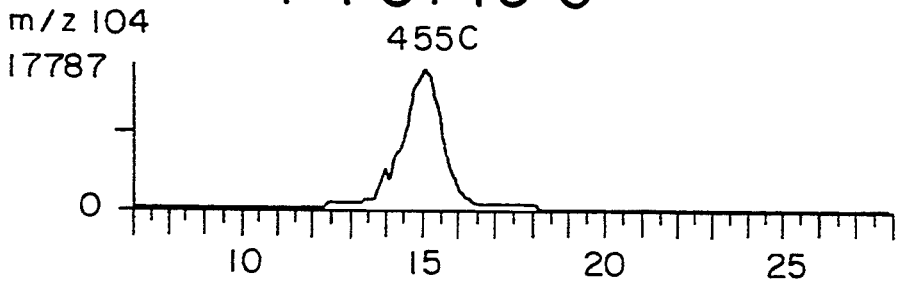
Figure 19D:
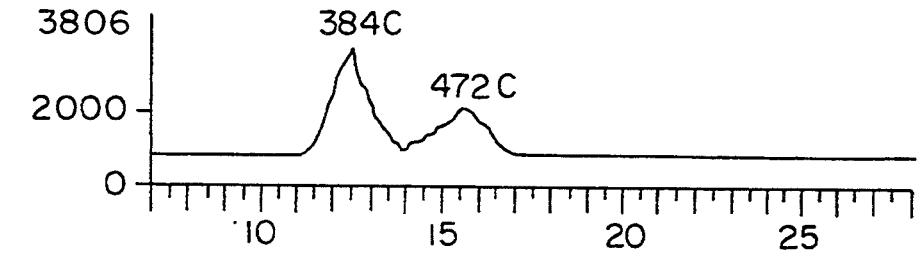

The mass spectral analysis of the pyrolysis of polyethylene, PET, and polypropylene were shown in FIGS. 3 and 11. Polyvinylchloride at 504° C. in helium is shown in FIG. 18. The time-resolved profile of HCl is shown in FIG. 18A and the average spectrum over the time for the entire evolution of products is shown in FIG. 18B. The product distribution is typical of vinyl polymers with stripping of the HCl leaving a hydrogen deficient backbone which undergoes aromatization to form benzene and condensed aromatics. The mass spectral analysis of the pyrolysis of polystyrene at 506° C. in helium is shown in FIGS. 18C and D. The time-resolved profile of styrene is shown in FIG. 18C and the average spectrum over the time for the entire evolution of products is shown in FIG. 18D, which shows the predominance of the monomer at m/z 104. The scanning to higher masses shows oligomers up to the limit of the instrument (800 amu).

Because of the relatively low value of these materials, a simple process conception that allows the recovery of styrene and light gases is readily apparent. Synthetic mixtures of HDPE, PVC, PS, and PET were subjected to slow heating (30° C./min) alone and in the presence of various trial catalysts. The time-resolved evolution curves of the major product classes for the uncatalyzed example are shown in FIG. 19. This figure shows that styrene can be separated reasonably well from the polyolefin-derived products. Once the products are formed the pyrolysis product composition can be changed by subjecting the vapors to vapor phase pyrolysis with the goal of optimizing the yield of styrene and effecting easier separation by cracking the PE-derived products to lighter gases that will remain in the vapor phase as the styrene is condensed.

The conditions under which pyrolyses of waste containing PVC, PET, PS and PE may be accomplished are as follows:

| Feedstock | Conditions* | Preferred | Products |
|---|---|---|---|
| PET | Temp1: 200–400 | 250–350 | HCl, TPA |
| PS | Temp2: 250–550 | 350–475 | styrene |
| PE as in: residential waste, manufacturing waste | Temp3: 350–700 | 475–600 | hydrocarbons |

*Temperature are for sequential stages of pyrolysis to separate products.

EXAMPLE 4

POLYURETHANE WASTE PYROLYSIS

Figure 20A:
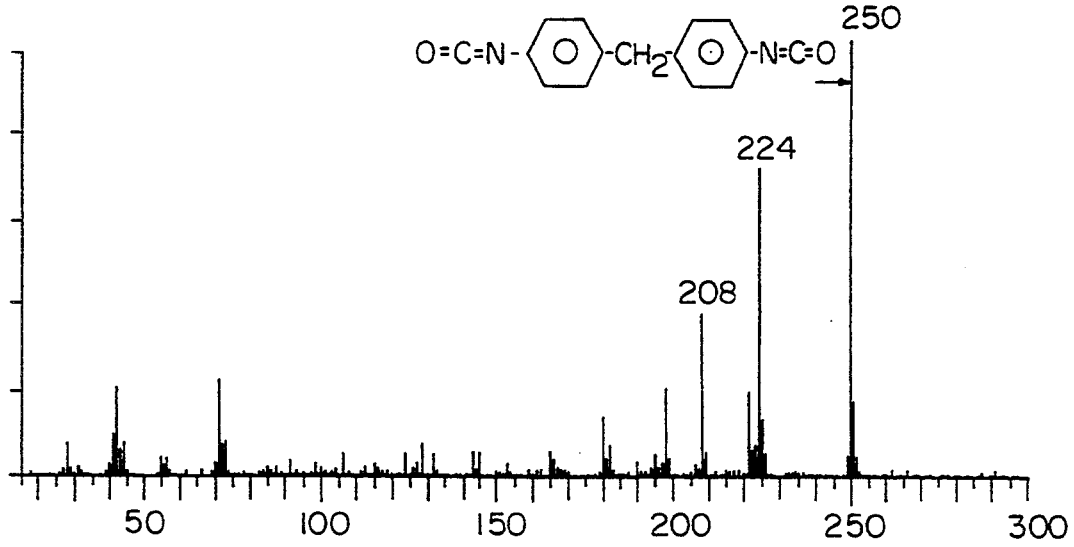
FIG. 20 shows the spectra of the pyrolysis of polyurethane with no steam (A) and with steam (B).
Figure 20B:
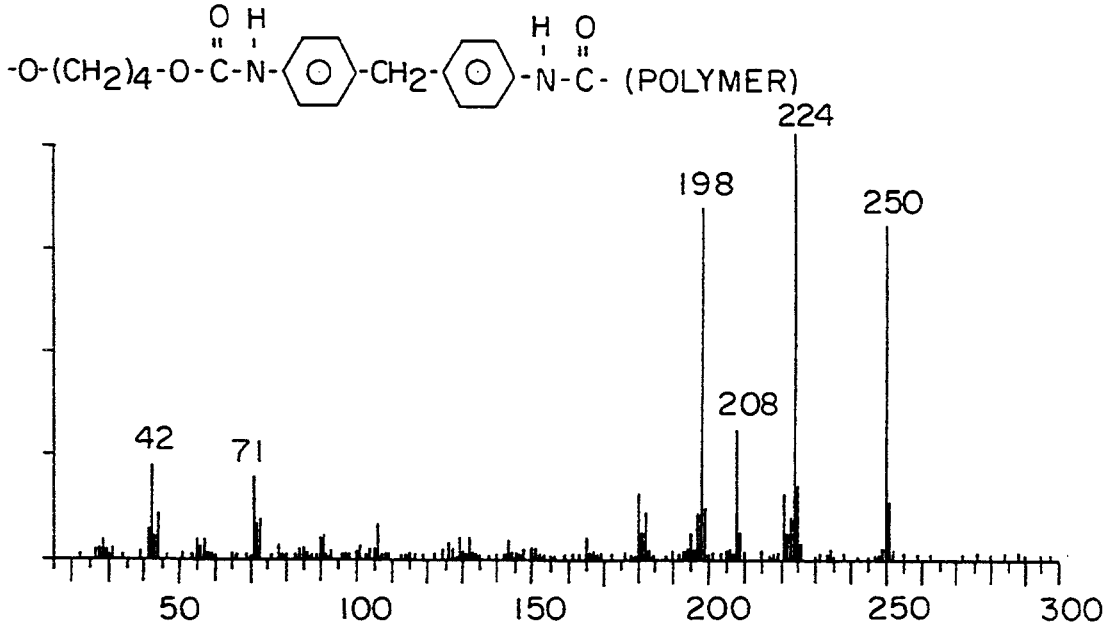

Polyurethane is the major plastic component of autoshredder and furniture upholstery waste and formation and separation of the monomers from other plastic pyrolysis products and/or pure polyurethane pyrolysis is the goal. However, by analogy with the previous examples, which were successful using mixtures, the same techniques can be applied to polyurethane waste mixtures as in the previous three examples. The spectrum of the pyrolysis of polyurethane, from a commercial source, is shown in FIG. 20A. The spectrum of the products from pyrolysis in steam is shown in 20B. The increased intensity of the peaks at m/z 224 and 198 with the presence of stem is to be noted. This is due to the hydrolysis of the isocyanate group to the amino group.

Figure 21:
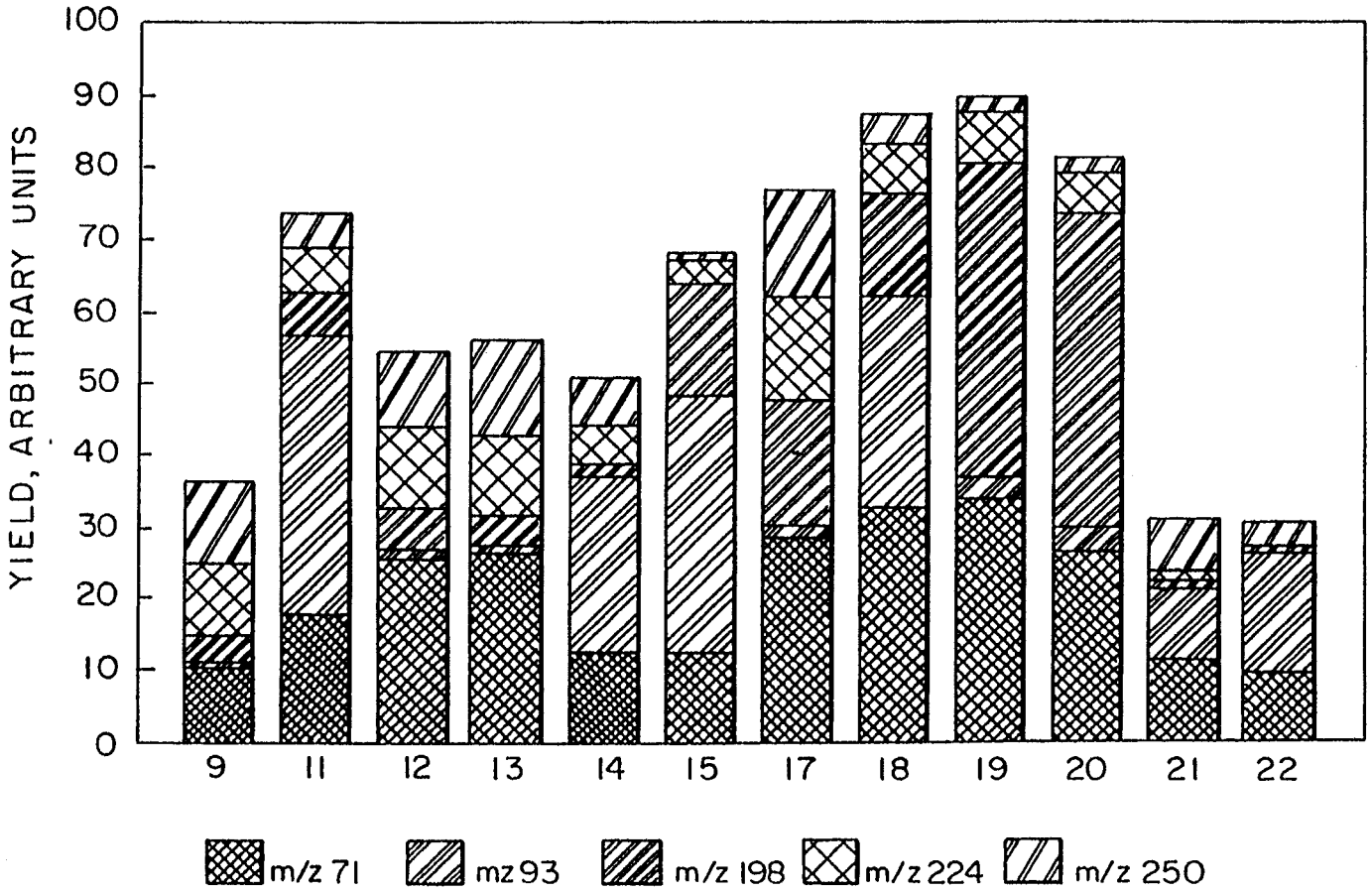
FIG. 21 shows the effect of operating conditions (see table 4) on product distribution, where m/z 71 is due to tetrahydrofuran, m/z 93 is due to aniline, m/z 198 is due to methylene-4-aniline-4'-phenylisocyanate, and m/z 250 is due to methylenedi-p-phenyl diisocyanate.
Figure 22A:
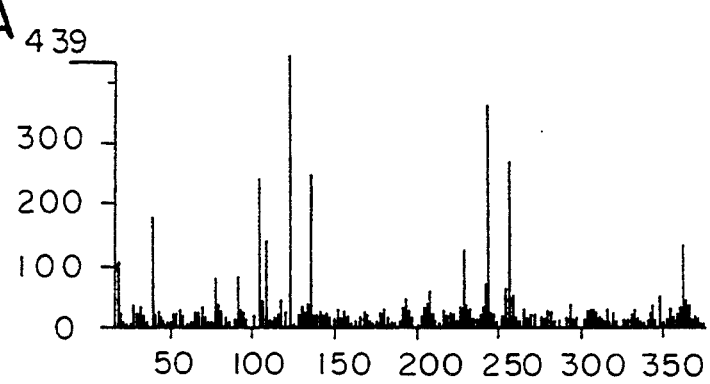
FIG. 22 shows the pyrolysis products from a mixture of polyphenyleneoxide (PPO) and polystyrene (PS) at 440° C., where: (A) is the average spectrum taken from 150 to 330s; (B) is the time-resolved profiles of the major products from PPO pyrolysis (m/z 122); (C) is the time-resolved profile of the major product from PS pyrolysis (m/z 104); and (D) is the average spectrum of the products from 40 to 150s.
Figure 22B:
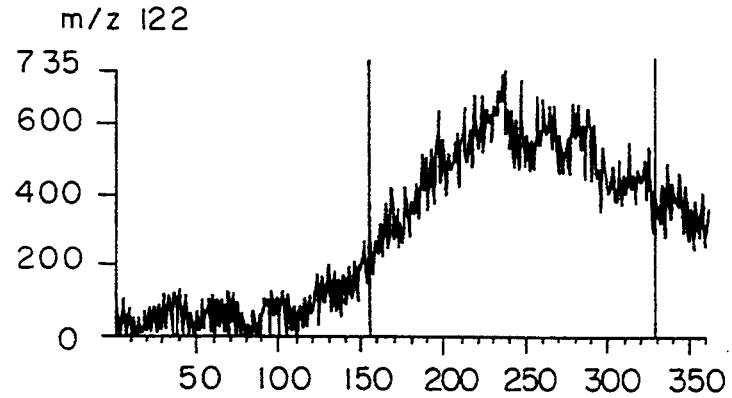
Figure 22C:
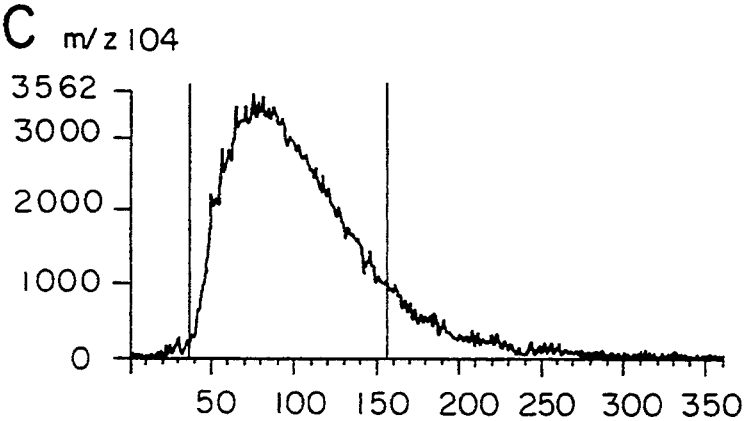
Figure 22D:
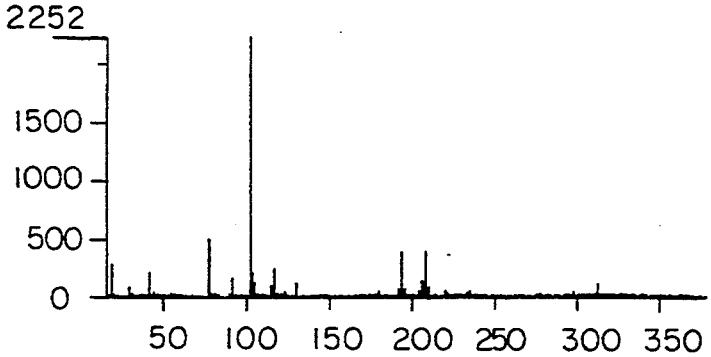

To determine the effect of operating conditions on yield, each run is compared to argon which is present in the carrier gas at a level of 0.15% and hence allows a direct comparison of product yields as well as distribution. FIG. 21 summarizes the distribution of products from PU pyrolysis under a variety of conditions that are summarized in Table 4.

TABLE 4

REACTION CONDITIONS USED IN THE STUDY OF POLYURETHANE PYROLYSIS

| Run# | Temp °C. | Carrier | Catalyst | Support |
|---|---|---|---|---|
| 9 | 500 | He | — | — |
| 11 | 500 | He | — | $SiO_2$ |
| 12 | 500 | He | — | $CaCO_3$ |
| 13 | 500 | He | — | $\alpha$-$Al_2O_3$ |

TABLE 4-continued

REACTION CONDITIONS USED IN THE STUDY OF POLYURETHANE PYROLYSIS

| Run# | Temp °C. | Carrier | Catalyst | Support |
|---|---|---|---|---|
| 14 | 500 | He | PVC | $SiO_2$ |
| 15 | 500 | He | $Ca(OH)_2$ | $SiO_2$ |
| 17 | 500 | $H_2O$ | — | — |
| 18 | 500 | $H_2O$ | — | $SiO_2$ |
| 19 | 500 | $H_2O$ | — | $\alpha$-$Al_2O_3$ |
| 20 | 500 | $H_2O$ | — | $CaCO_3$ |
| 21 | 500 | $H_2O$ | PVC | $SiO_2$ |
| 22 | 500 | $H_2O$ | PVC | $SiO_2$ |

The highest yields of the diisocyanate at m/z 250 occur with no steam and no catalyst present but the overall yield of all products is lower in this case (run#9). The presence of $SiO_2$ catalyzes the formation of aniline (m/z 93) in run #11. The polyol component of the urethane forms tetrahydrofuran as shown by m/z 71, which has a yield that is dependent on reaction conditions. The presence of steam in runs 17–22 tends to form more of the amino products at m/z 198 and 224, as well as to give higher overall yields, resulting in an increase by a factor of almost three for runs 18 and 19 over the untreated sample (run#9). The presence of PVC in runs, 14, 21 and 22 tends to have a deleterious effect, especially when steam is present. This problem can be circumvented by utilizing temperature-programmed pyrolysis, where the PVC-derived HCl can be driven off at a much lower temperature. The dianiline (4,4'-diamino-diphenyl methane) product at m/z 198 is formed in high yields in runs 19 and 20 with minimal amounts of other products, except THF which can be sold as products. The dianiline product is used as a cross-linking agent in the curing of epoxides and various other applications (synthesis of isocyanates) and therefore represent a higher value product to energy alone.

The conditions under which pyrolyses of PVC and PV in waste such as autoshredder residue and upholstery are accomplished, are as follows:

| Feedstock | Conditions | Preferred | Products |
|---|---|---|---|
| PVC<br>PU<br>as in:<br>autoshredder residue, upholstery waste | Temp1: 200–400<br>Temp2: 300–700 | 250–350<br>400–600 | HCl<br>m/z 250[1]<br>m/z 224[2]<br>m/z 198[3]<br>aniline<br>THF |
| | Catalysts: base catalysts, oxides and carbonates | $Ca(OH)_2$<br>$SiO_2$,<br>$\alpha$-$Al_2O_3$,<br>$CaCO_3$ | |
| | Carrier Gas: inert gases, stream, CO process recycle gases | inert,<br>steam[4] | |

[1]methylene-4,4'-di-aniline
[2]methylene-4-aniline-4'-phenyl-isocyanayte
[3]methylene-di-p-phenyl-di-isocyanate
[4]preferred conditions depends on desired products

EXAMPLE 5

POLYPHENYLENEOXIDE AND POLYSTYRENE MIXTURES AS OCCURS IN ENGINEERING POLYMER BLENDS

Figure 23A:
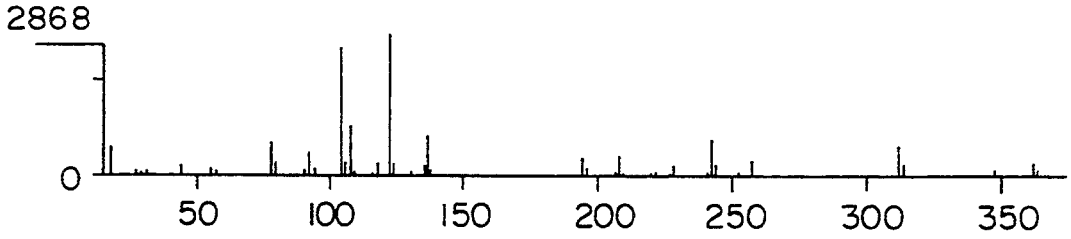
FIG. 23 shows the pyrolysis products from a mixture of PPO and PS with the catalyst KOH on $\alpha$-$Al_2O_3$ at 440° C. where: (A) is the average spectrum taken from 45 to 175s; and the time-resolved profiles of the major products from pyrolysis of: (B) PPO (m/z 122) and (C) PS (m/z 104).
Figure 23B:
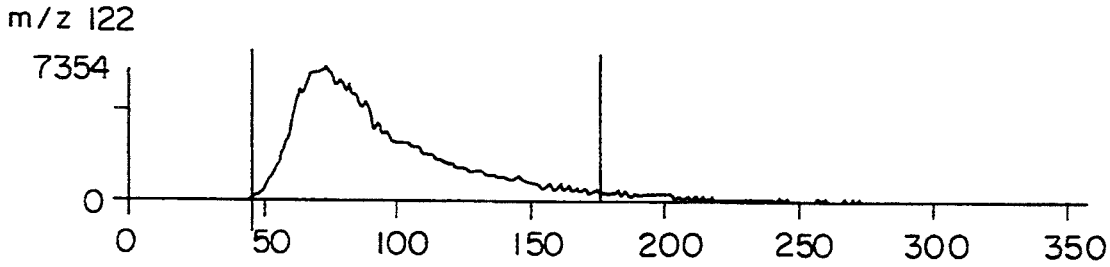
Figure 23C:
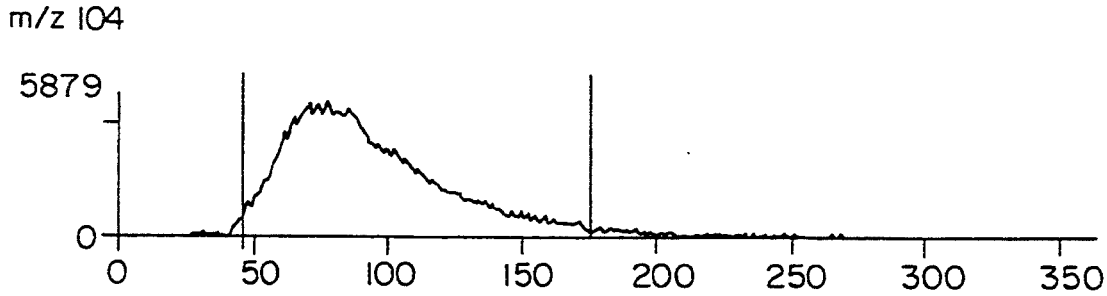

The pyrolysis products from a mixture of these two polymers are shown in FIG. 22 along with the time-resolved profiles of the major products of each polymer. The PPO gives a homologous series of m/z 108, 122, 136 where m/z 122 is due to the monomer (although actual structural isomer distribution must be determined). The peaks at m/z 108 and m/z 136 are due to the loss and gain of one methyl group, respectively. The same homologous series are observed at the dimer (m/z 228, 242, and 256) as well as higher oligomer weights (not shown). Catalyst have been identified that speed the reaction of PPO, but at best it makes the PPO-derived products coevolve with-the PS products as shown in FIG. 23 where the catalyst KOH on $\alpha$-$Al_2O_3$ was used. These catalysts have not affected the distribution of the PPO-derived products, but just the rate of product evolution.

One process option is to pyrolyze the polystyrene at a low temperature to form styrene and leave the PPO unreacted, except for a probable decrease in the molecular weight range of the molten material. The low molecular weight PPO could then be reused in formulation of PPO or other PPO/PS blends. A simple pyrolysis reactor, similar to that shown in Canadian Patent 1,098,072 (1981) or JP61218645 (1986) may be used to affect both styrene and molten PPO recovery.

The invention conditions under which pyrolyses of waste containing PS and PPO (as in engineering plastic waste) PPC, and PS as in engineering plastic waste, are as follows:

| Feedstock | Conditions* | Preferred | Products |
|---|---|---|---|
| (case 1) | | | |
| PS<br>PPO<br>as in:<br>engineering plastic waste | Temp1: 250–550 | 400–500 | styrene<br>molten PPO |
| | Catalysts: none | none | |
| | Support: none | none | |
| | Carrier Gas: inert, gases, steam, $CO_2$, process recycle gases | inert gases, steam, $CO_2$, process recycle gases | |
| (case 2) | | | |
| PPO | Temp1: 250–550 | 400–500 | methyl-phenol<br>dimethyl-phenol<br>trimethyl-phenol |
| PS<br>as in:<br>engineering plastic waste | Temp2: 350–700 | 450–600 | styrene |
| | Catalysts: acid or base catalysts | KOH | |
| | Supports: oxides and carbonates | $\alpha$-$Al_2O_3$ | |
| | Carrier Gas: inert, gases, stream, $CO_2$ process recycle gases | inert gas steam, $CO_2$, process recycle gases | |

*Preferred conditions depend on desired products.

EXAMPLE 6

RECOVERY OF BISPHENOL A AND OTHER PHENOLIC COMPOUNDS FROM POLYCARBONATE AND MIXTURES OF POLYCARBONATE AND OTHER POLYMERS SUCH AS ABS, PS . . .

Figure 26:
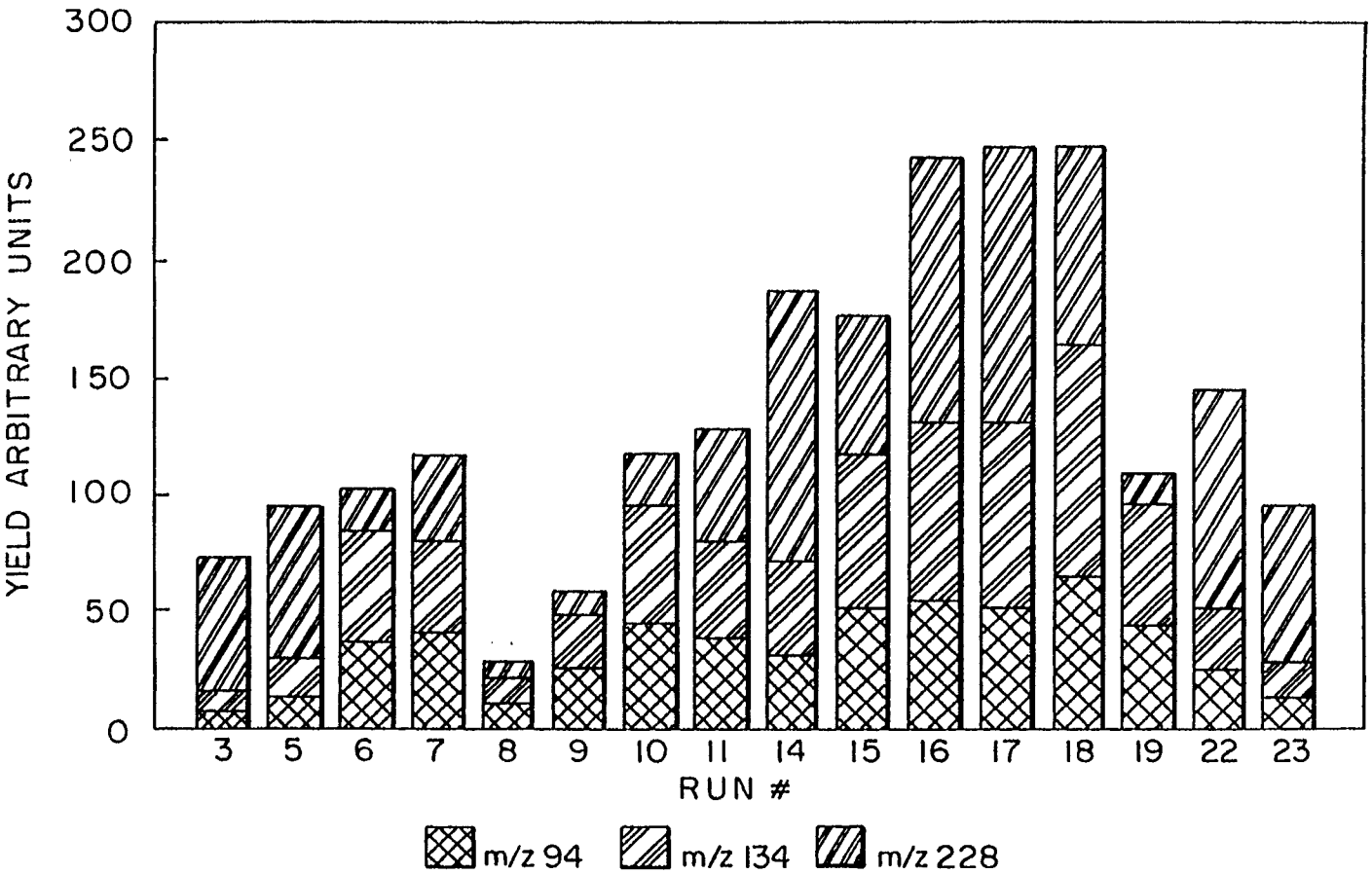
FIG. 26 shows the yield of major products from the pyrolysis of polycarbonate under the conditions outlined in Table 5, where m/z 94 is due to phenol, m/z 134 is due to propenylphenol and m/z 228 is due to bisphenol A.

Catalysts to accelerate the pyrolysis of polycarbonate and lead to the maximum yield of bisphenol A (m/z 228), the starting material for that and other plastics, are necessary to recover the maximum yield and product selectivity. A summary of reaction conditions is shown in Table 5 and the results are presented in FIGS. 24–26.

The mixture of phenolics produced here could be used to replace phenol in phenolic resins.

TABLE 5

| EXPERIMENTAL CONDITIONS OF POLYCARBONATE PYROLYSIS | | | | |
|---|---|---|---|---|
| Run# | Temp °C. | Carrier | Catalyst | Support |
| 3 | 470 | He | — | — |
| 5 | 470 | He | — | $CaCO_3$ |
| 6 | 470 | He | $Ca(OH)_2$ | — |
| 7 | 470 | He | PVC | — |
| 8 | 480 | He | — | $SiO_2$ |
| 9 | 470 | He | $Ca(OH)_2$ | $SiO_2$ |
| 10 | 470 | He | $Ca(OH)_2$ | $CaCO_3$ |
| 11 | 470 | He | PVC | $CaCO_3$ |
| 14 | 470 | He | — | — |
| 15 | 480 | $H_2O$ | $Ca(OH)_2$ | — |
| 16 | 470 | $H_2O$ | PVC | — |
| 17 | 470 | $H_2O$ | PVC | $CaCO_3$ |
| 18 | 470 | $H_2O$ | $Ca(OH)_2$ | $CaCO_3$ |
| 19 | 470 | $H_2O$ | $Ca(OH)_2$ | $SiO_2$ |
| 22 | 500 | $H_2O$ | — | — |
| 23 | 500 | He | — | — |

Figure 24A:
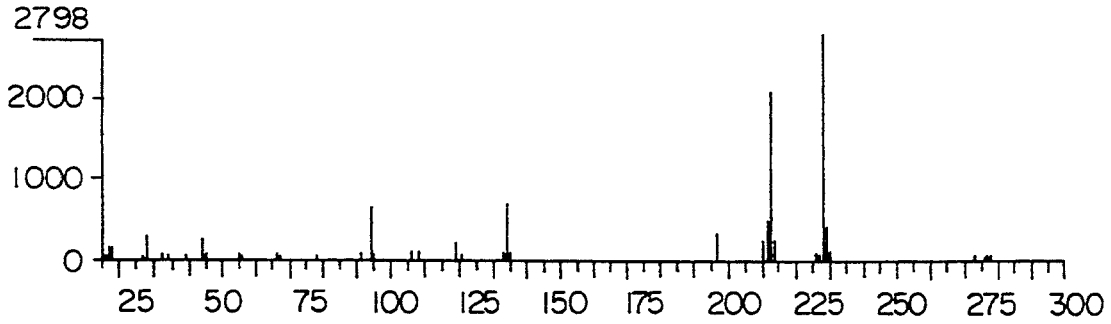
FIG. 24 shows the pyrolysis of PC at 470° C. under different conditions; where: (A) is the addition of $CaCO_3$; (B) the copyrolysis of PC and PVC giving the repeating unit at m/z 254 as well as low molecular weight phenolics; and (C) pyrolysis in the presence of steam producing more higher mass compounds.
Figure 24B:
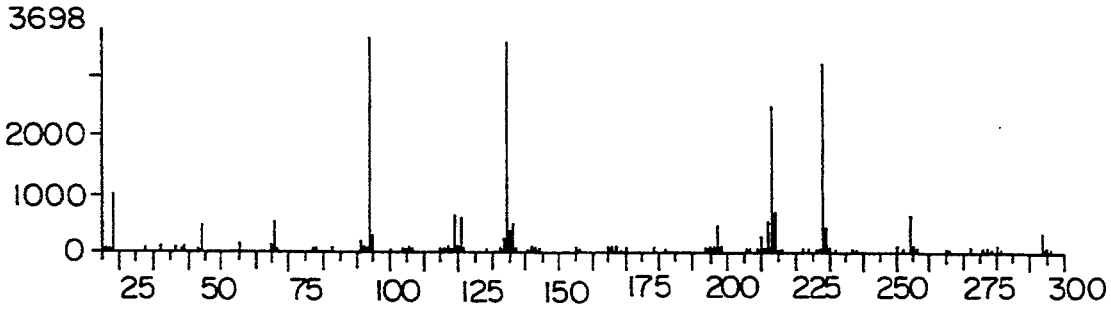
Figure 24C:
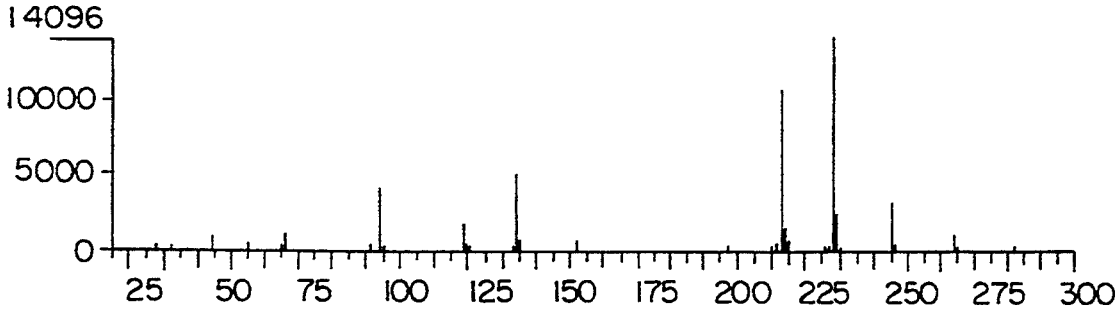
Figure 25A:
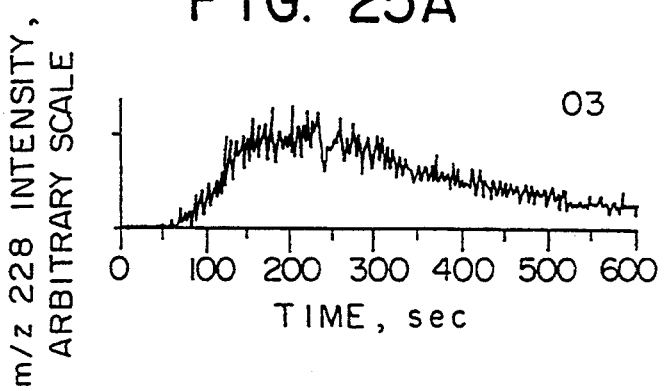
FIG. 25 shows the evolution profile of m/z 228 (bis phenol A) from the pyrolysis of polycarbonate under various conditions as outlined in Table 5.
Figure 25B:
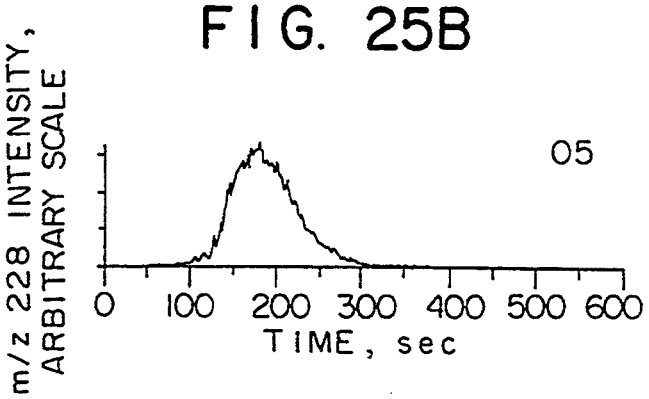
Figure 25C:
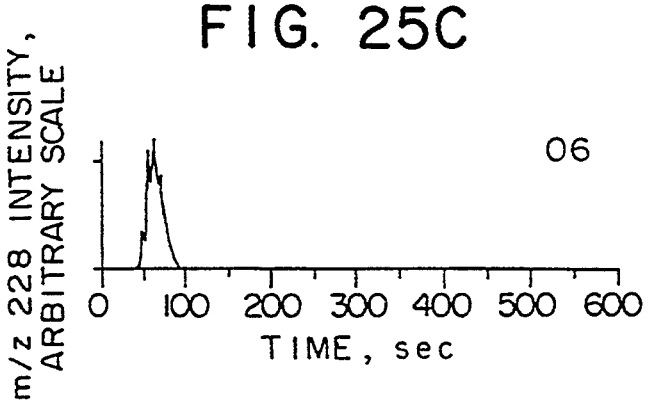
Figure 25D:
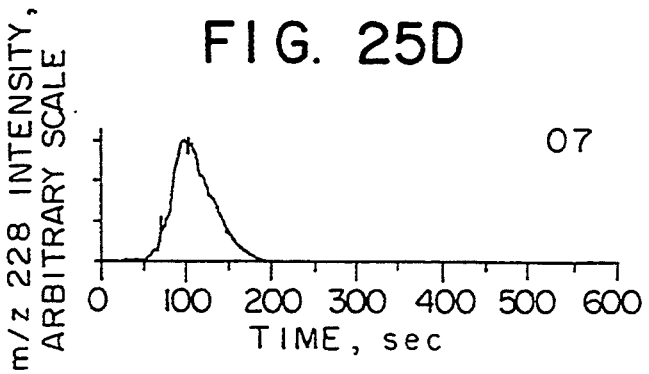
Figure 25E:
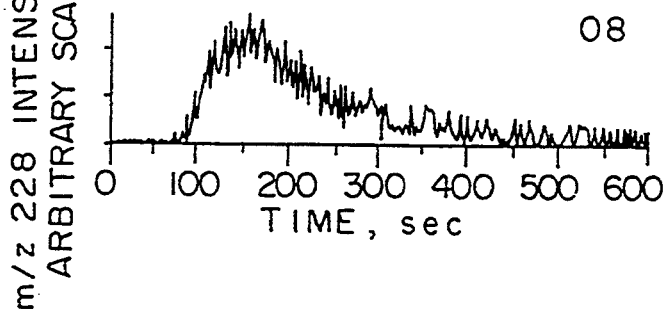
Figure 25F:
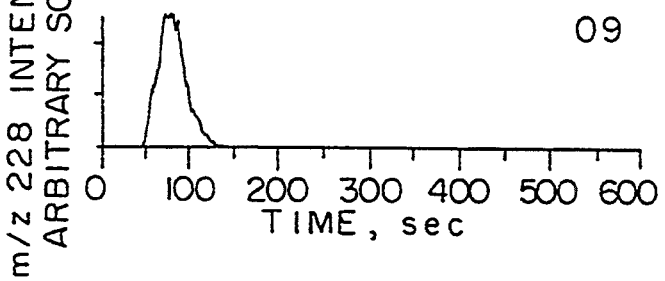
Figure 25G:
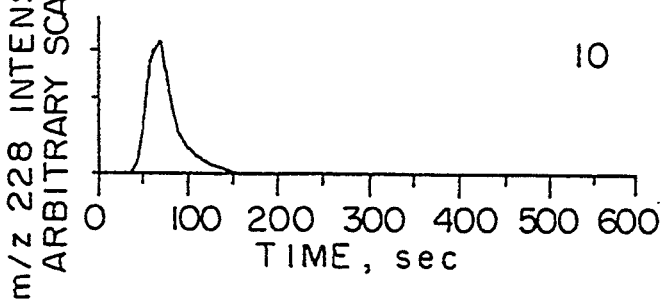
Figure 25H:
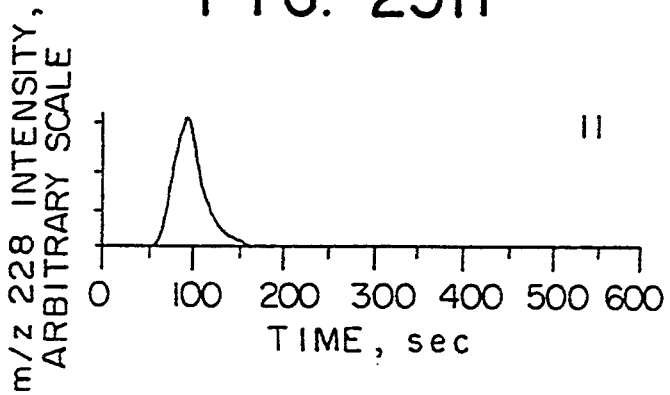
Figure 25I:
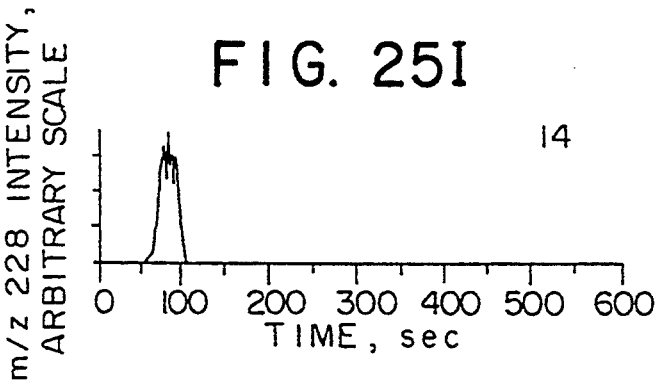
Figure 25J:
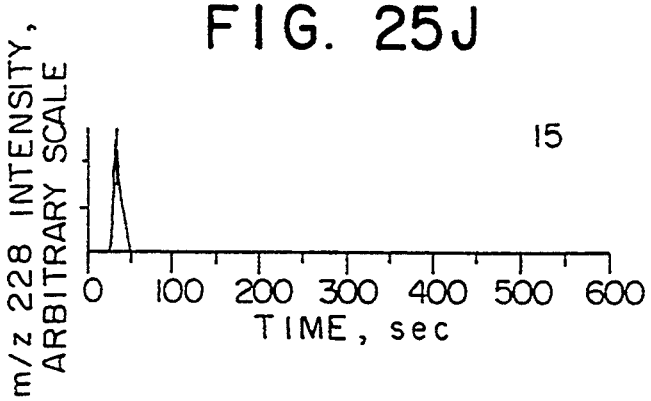
Figure 25K:
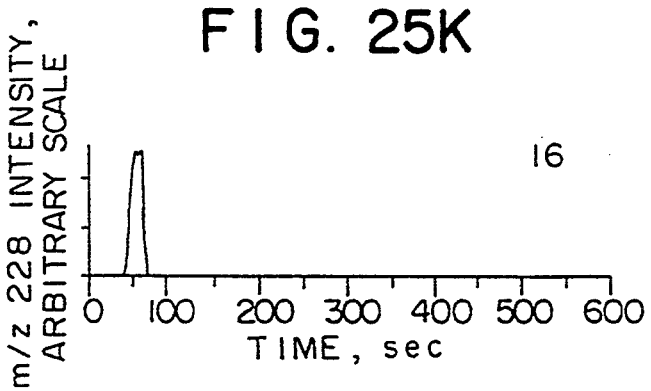
Figure 25L:
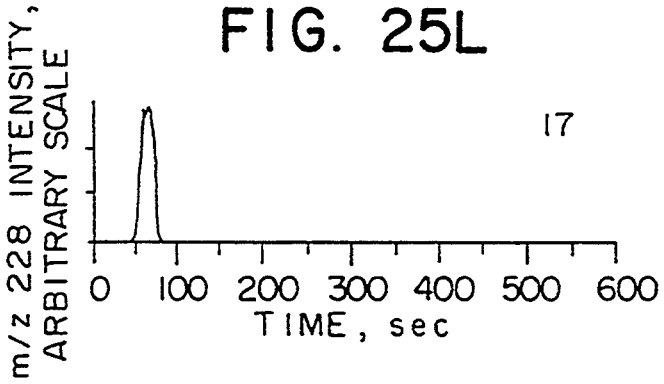
Figure 25M:
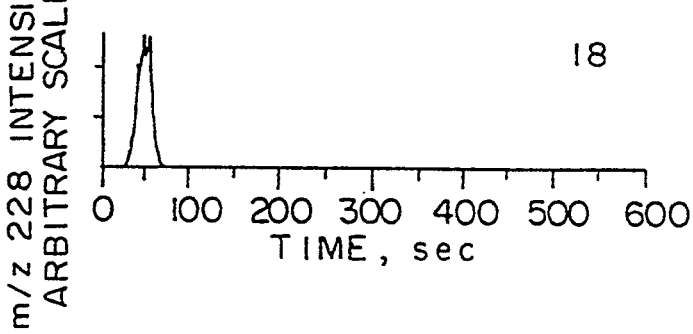
Figure 25N:
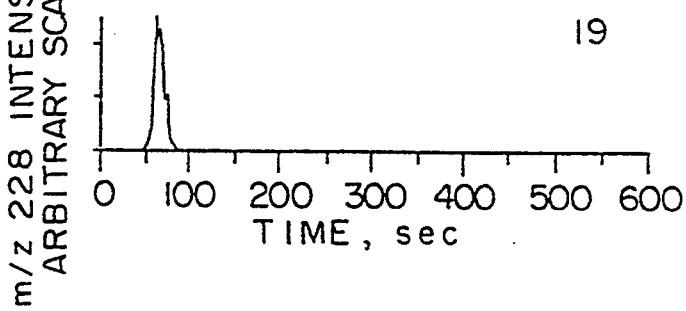
Figure 250:
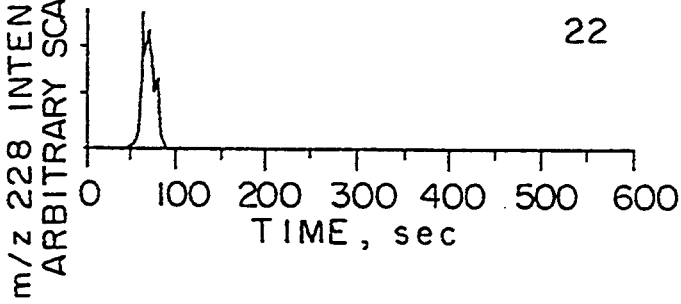
Figure 25P:
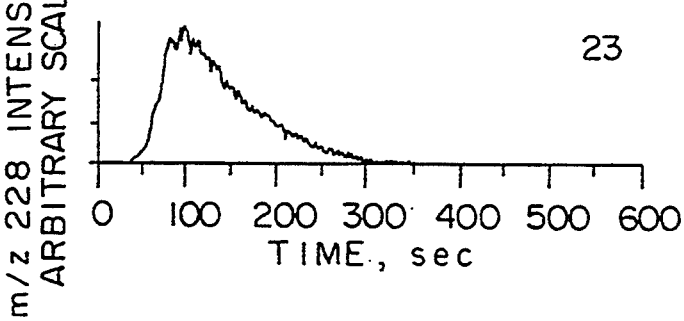

Representative variations in product composition are shown in FIG. 24. The use of $CaCO_3$ (run #5, spectrum shown in FIG. 24A) as a support was better than $SiO_2$ (run#8) which was much better than alumina (results not shown). In addition, $SiO_2$ produced lower yields of bisphenol A. The copyrolysis of PC and PVC yielded the repeating unit in polycarbonate at m/z 254 shown in FIG. 25B, as well as more low molecular weight phenolics such as phenol (m/z 94) and propenylphenol (m/z 134). The presence of steam (FIG. 25C) has the most significant effect on both rate and yield as shown by the comparisons between runs 3 and 14 at 470° C. and runs 22 and 23 at 500° C. The presence of PVC (treated here as an in situ acid catalyst) gives the same yield of bisphenol A (runs #16 and #17) as the steam alone case (#14), but higher yields of phenol and propenylphenol. The presence of $CaCO_3$ in run #17 appears to have no effect on yields or reaction rates when compared to run 16, despite the significant difference in rate between runs #3 and #5. The presence of $Ca(OH)_2$ and the steam appears to change the product distribution; but not the overall yield, however, when $CaCO_3$ is added as a support, the yield is increased. The preferred conditions are the presence of steam, $Ca(OH)_2$, and $CaCO_3$ and under these conditions the presence of PVC will also lead to enhanced yields.

Figure 27A:
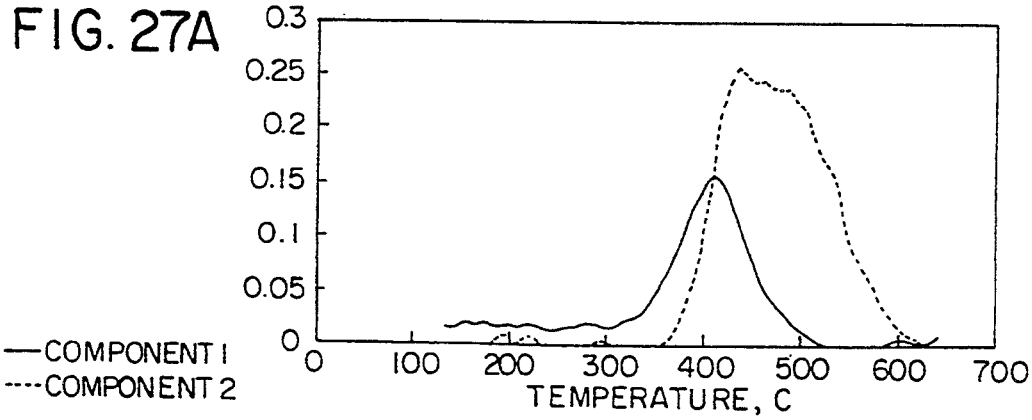
FIG. 27A shows the temperature trace.
Figure 27B:
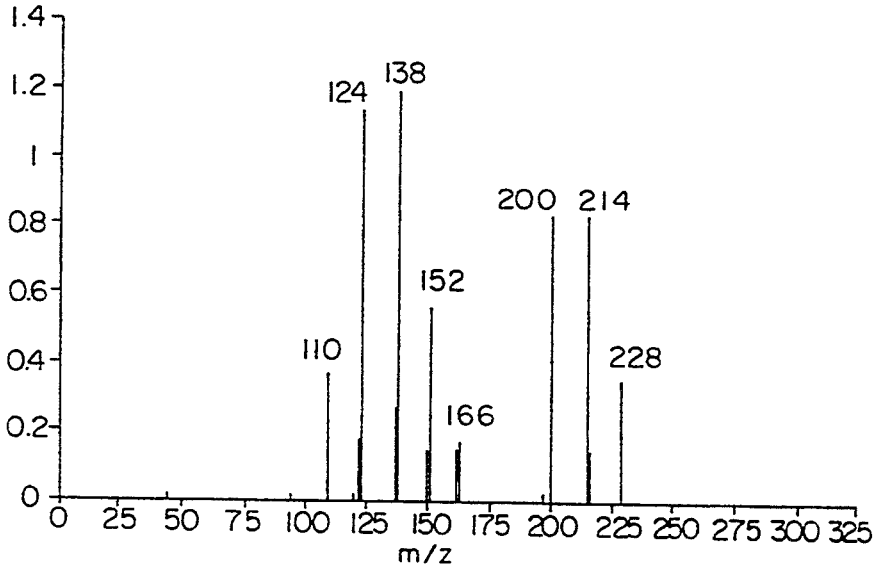
FIG. 27B shows the time-resolved profile m/z 134 due to propenylphenol derived from PC.
Figure 27C:
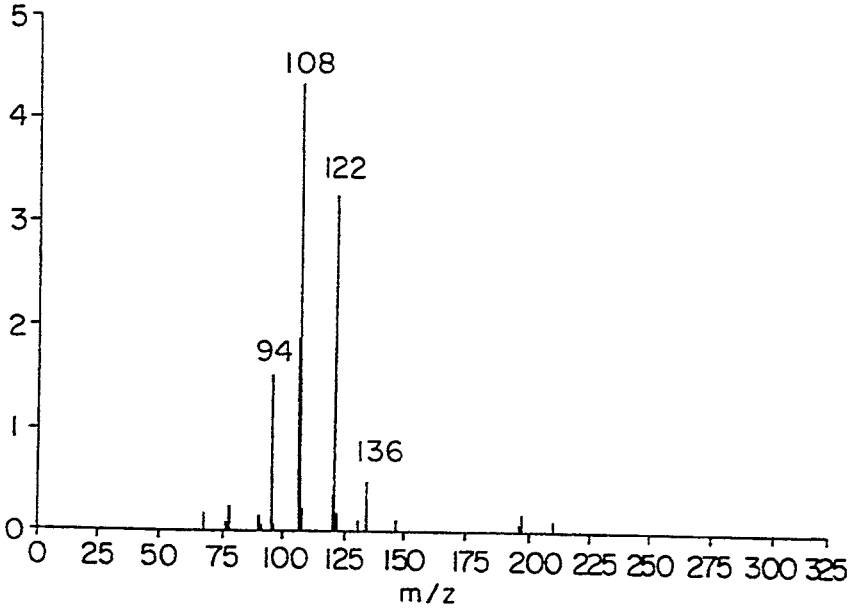
FIG. 27C shows the time-resolved profile of m/z 104 due to styrene derived from ABS.

These reaction conditions can be used to separate the products of PC pyrolysis from those of ABS, which is commonly combined with PC in polymer blends for high value applications. FIG. 27 shows the use of temperature-programmed pyrolysis in the presence of $Ca(OH)_2$ as a catalyst and with steam in the carrier gas. The temperature is ramped to 350° C. and held for 8 minutes during which time the products of PC are observed as shown by propenyl phenol in FIG. 27B. At 8 minutes, the temperature was ramped to 400° C. and an increased rate of PC product evolution was observed along with the beginning of styrene from the ABS. The temperature was ramped to 500° C. at 12 minutes and the major product evolution of ABS was observed as well as some PC-derived products. In this example, the separation was not optimized as far as the setting of the first temperature, but over half of the PC-derived products were obtained prior to the onset of the ABS-derived product.

Further conditions under which pyrolysis of PC and ABS may proceed in accordance with Example 6 are as follows:

| Feedstock | Conditions* | Preferred | Products |
|---|---|---|---|
| PC | Temp1: 300–500 | 350–450 | BisPhenol A |
| ABS | Temp2: 350–700 | 400–450 | styrene |
| as in: | hydrocarbons | | |
| engineering plastic waste | Catalysts: acid or base catalysts | Ca(OH)2 | |
| | Supports: oxides and carbonates | none | |
| | Carrier Gas: inert, gases, stream, $CO_2$, process recycle gases | inert steam[1] | |

*Temperatures are for sequential stages of pyrolysis to separate products.
[1]Preferred conditions depend on desired products.

These examples illustrate that polycarbonate—and polyphenylene oxide—containing mixtures/blends of polymers can upon pyrolysis under appropriate conditions lead to the recovery of phenolic compounds, which could be a source of phenols for a variety of applications such as phenolic and epoxy resins (low grades) or some resins, if the degree of purity is sufficient as recovered and purified.

KEY DIFFERENCES BETWEEN THE PRESENT INVENTION AND THE PRIOR ART

1) Nylon 6 to caprolactam.

The literature of catalyzed pure nylon-6 pyrolysis by I. Luderwald and G. Pernak in the Journal of Analytical and Applied Pyrolysis, vol. 5, 1983, pp. 133–138 finds a metal carboxylate as a catalyst for the thermal degradation of nylon 6. The authors propose that the mechanism of the reaction is analogous to the reverse anionic polymerization mechanism by which caprolactam is polymerized to nylon 6. The initial step is the deprotonation of an amide group of the polymer followed by nucleophilic substitution of a neighboring carbonyl group. The literature finds considerable differences in the behavior of the various carboxylates as a function of their pK, which seems to lend credibility to the proposed mechanism. The reactions were carried out at 280° C. and in vacuum of nearly 10 torr. These conditions are substantially different than those identified in the present invention, in which a variety of basic and acidic catalysts have been identified that accelerate the pyrolysis of nylon 6 in the presence of PP, and also in the presence of dyes, which can also be acidic or basic organic compounds. Base catalysts on various supports (e.g., aluminates, base form of silicas or aluminas) can increase the yield of caprolactam by more than a factor of two and increase the rate of production of the monomer by factors of 2–5. The yield of caprolactam recovered is similar in both cases (85%), but the rates are substantially different. Whereas the published data report at a degradation rate of 1 wt % per minute, the catalysts identified here degrade nylon 6 at a rate of 50 wt % per minute in the presence of PP. The present invention is carried out under very cost-effective conditions of near atmospheric pressure (680 torr). The prior art closest to the present invention requires high vacuum and the prior art is aimed at the investigation of the degradation and does not mention using the catalysts to easily separate nylon 6 pyrolysis products from those of other plastics present in the mixture of carpet, textile, or other wastes containing nylon 6, as does the invention.

The present invention has a major advantage, since the overall process for nylon carpet waste recovery of caprolactam is simple, the technology is expected to be very cost effective. A detailed technoeconomic assessment reveals that the production of 10–30 million pounds of caprolactam per year would lead to an amortized production cost of $.50–$0.15/lb (20 year plant life) with a low capital investment (15% ROI). Caprolactam sells near $1.00/lb. These figures conclusively indicate that the present process is economically attractive for the recovery of a substantial fraction of the nylon 6 value from carpet wastes. Not only manufacturing wastes but also household carpets could be recycled into caprolactam. In addition, nylon 6 is used to manufacture a variety of recreational products. Waste from these processes could also be employed.

Other processes that address making monomers from a variety of nylons is directly heating the polyamide with ammonia in the presence of hydrogen and a catalyst. Nylons in general such as polycaprolactam (nylon 6), polydodecanolactam (nylon 12), polyhexamethylene adipamide (nylon 6,6) and polymethylene sebacamide (nylon 6, 10) can be treated by this process. The process employs very Nigh pressures of about 1000 atm (1000×760 torr). Anhydrous liquid ammonia is the reactive solvent. Hydrogen is added as well as hydrogenating catalysts such as nickel (Raney nickel), cobalt, platinum, palladium, rhodium, etc. supported on alumina, carbon, silica, and other materials. Temperature ranges of 250°–350° C. were employed, with reaction times of 1 to 24 hours. Additional solvents such as dioxane can also be employed. Nylon 6 products: 48 mole % hexamethyleneimine, 19 mole % of hexamethylene-1, 6-diamine, and 12 mole % of N-(6-aminohexyl)-hexamethyleneimine. Nylon 6, 6 products: 49 mole % of hexamethylene-imine and 27% hexamethylene-1, 6-diamine.

It is apparent that there is no similarity between this prior art and the present invention.

The art that appears most pertinent to the present invention, but is not immediately apparent that it would be applicable to polyamides is in the area of the recovery of epsilon-caprolactone in good yield from oligomers of polyesters (U.S. Pat. No. 3,546,251, 1970). Recovery of epsilon-caprolactone in good yield from oligomers or polyesters of epsilon-caprolactone containing or not containing epsilon-caprolactone, or epsilon-hydroxy caproic acid is achieved by heating at 210°–320° C. with 0.5 to 5 parts wt. of catalyst (per 100 parts wt. starting material) chosen from KOH, NaOH, alkali earth metals hydroxides, the salts of alkali metals, e.g. Co and Mn and the chlorides and oxides of divalent metals.

The preparation of epsilon-caprolactone by oxidation of cyclohexane always yields quantities of oligomers and polyesters. By this thermal process, these reaction by-products are readily converted to epsilon-caprolactone in 80–90% yield. However, a major difference between this art and the present invention is that the stream addressed is a plastic in-plant manufacturing waste stream of a polylactone, which contains a variety of low molecular weight oligomers, in the presence of the polyesters, while the present invention addresses a consumer product manufacture mixed waste stream that contains a very high level of impurities (e.g. 10% by weight of dyes in the carpet are common). In addition, the stream also contains a substantial proportion of polypropylene, used as backing for the carpet. It is not apparent that these impurities, principally the acidic dyes, would not interfere with the process chemistry and lead to products different than caprolactam. The extrapolation of these conditions to the current invention in which the catalysts are aluminares or silicates (alumina or silica treated with alkali/alkali earth metal hydroxides) at higher temperatures and the polymers are polyamides not polylactones, are significant differences from the prior art. Even in the seminal paper by W. H. Carrothers et al., J. American Chemical society, vol. 56, p. 455, 1934, in which they describe that monomers can be obtained on heating polyesters in the presence of a catalyst, they also demonstrate that that fact was not always likewise applied to various kinds of polyesters. In fact, very small yields of the lactone were obtained by Carrothers and coworkers, compared to the work of S. Matsumoto and E. Tanaka (U.S. Pat. No. 3,546,251). These authors claim specifically zinc, manganese, and cobalt acetates as catalysts for the production of monomeric lactones.

2) Terephthalic Acid or Esters from PET

The prior art is based on hydrolysis and solvolysis of pure PET streams. These involve the presence of a solvent, a catalyst, and high-temperature and pressures, as distinguished from the present invention, in which steam or methanol is added at near atmospheric pressure. In addition, for the solvolysis/hydrolysis of the prior art, the presence of traces of PVC makes the process technically inviable. In the present invention, it has been demonstrated that the PVC can be used to generate a catalyst for the process in situ, and this is a novel discovery.

3) Other plastic pyrolysis

Although there is substantial literature of the pyrolysis of these plastics as an analytical tool for the identification of these polymers in mixtures, as well as some work dealing with the mixtures of plastics addressing the formation of liquid fuels or a variety of products, the specific conditions for the formation of essentially simple pyrolysis products in high yields has not been identified in the prior art. This applies to PPO, PC, and blends of these polymers with other materials.

While the foregoing description and illustration of the invention has been shown in detail with reference to preferred embodiments, it is to be understood that the foregoing are exemplary only, and that many changes in the composition of waste plastics and the process of pyrolysis can be made without departing from the spirit and scope of the invention, which is defined by the attached claims.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to-be understood that the phraseology or terminology herein is for the purpose of description and not limitation.

What is claimed is:

1. A process of using fast pyrolysis in a carrier gas to convert a plastic waste feed stream containing a mixture of polystyrene and polyphenylene oxide in a manner such that pyrolysis of a given polystyrene and polyphenylene oxide and its monomeric constituent and derived product occurs prior to pyrolysis of other plastic components therein comprising:

a) selecting a first temperature program range of from about 250° to about 550° C. to cause pyrolysis of said given polystyrene and polyphenylene oxide and its monomeric constituent prior to a temperature range that causes pyrolysis of other plastic components;

b) selecting a catalyst and a support and treating said feed stream with said catalyst to affect acid or base catalyzed reaction pathways to maximize yield or enhance separation of said monomeric constituent of styrene from said polystyrene and polyphenylene oxide in said first temperature program range;

c) differentially heating said feed stream at a heat rate within the first temperature program range to provide differential pyrolysis for selective recovery of quantities of said monomeric constituent of styrene from said polystyrene and polyphenylene oxide prior to pyrolysis of other plastic components therein;

d) separating said monomeric constituent of styrene;

e) selecting a second temperature program range of from about 350° to about 700° C. to cause pyrolysis to a different derived product of polyphenylene oxide from said plastic waste and differentially heating said feed stream at said second temperature program range to cause pyrolysis of said plastic into a polyphenylene oxide derived product; and f) separating said different polyphenylene oxide derived product.

2. The process of claim 1, except that, no catalyst and no support are needed; and wherein the carrier gas is selected from inert gases, steam, $CO_2$ and process recycle gases.

3. The process of claim 1, wherein said waste feed stream comprises polystyrene and polycarbonate in blends or alloys.

4. The process of claim 3, wherein said polycarbonate is molten.

5. The process of claim 1, wherein said waste feed stream comprises polystyrene and phenolics.

6. The process of claim 2, wherein said temperature program range is between about 400° C. to about 500° C.

7. The process of claim 1, wherein said monomeric constituent is selected from methylphenol, dimethylphenol, trimethylphenol or mixtures thereof; and wherein said different monomeric constituent is styrene.

8. The process of claim 6, wherein the catalyst is KOH, the support is $\alpha$-$Al_2O_3$ and the carrier gas is selected from inert gases, steam, $CO_2$, and process recycle gases.

* * * * *